US010501972B2

(12) United States Patent
Twiggar, III et al.

(10) Patent No.: US 10,501,972 B2
(45) Date of Patent: Dec. 10, 2019

(54) REFRIGERATION SYSTEM AND CONTROL SYSTEM THEREFOR

(71) Applicant: Follett Corporation, Easton, PA (US)

(72) Inventors: Edward V. Twiggar, III, Nazareth, PA (US); Shawn P. Szilezy, Bath, PA (US); James Bottos, Nazareth, PA (US)

(73) Assignee: FOLLETT CORPORATION, Easton, PA (US)

( * ) Notice: Subject to any disclaimer, the term of this patent is extended or adjusted under 35 U.S.C. 154(b) by 796 days.

(21) Appl. No.: 14/674,408

(22) Filed: Mar. 31, 2015

(65) Prior Publication Data

US 2016/0290713 A1 Oct. 6, 2016

(51) Int. Cl.

| | |
|---|---|
| ***F25D 23/00*** | (2006.01) |
| ***F25D 23/02*** | (2006.01) |
| ***F25D 29/00*** | (2006.01) |
| ***E05D 7/00*** | (2006.01) |
| *F25D 21/08* | (2006.01) |

(52) U.S. Cl.

CPC ..... *E05D 7/00* (2013.01); *F25D 23/00* (2013.01); *F25D 23/02* (2013.01); *F25D 29/00* (2013.01); *F25D 21/08* (2013.01); *F25D 2323/022* (2013.01); *F25D 2400/361* (2013.01); *F25D 2700/10* (2013.01); *F25D 2700/16* (2013.01)

(58) Field of Classification Search

CPC ..... F25D 29/00; F25D 2700/16; F25D 2400/361; F25D 2700/02; F25D 2700/10; F25D 2700/121; F25D 2600/06; F25D 29/008; F25B 2700/2117; F25B 2700/21171; F25B 2700/21172; F25B 2700/21151; F25B 2700/21152; F25B 2700/2116; F25B 2700/21161

See application file for complete search history.

(56) References Cited

U.S. PATENT DOCUMENTS

| | | | |
|---|---|---|---|
| 2,779,165 | A | 1/1957 | Pichler et al. |
| 3,080,884 | A | 3/1963 | Nelson et al. |
| 3,341,065 | A | 9/1967 | Schuldt et al. |
| 3,771,560 | A | 11/1973 | Conti et al. |
| 4,074,987 | A | 2/1978 | Krulewich |

(Continued)

FOREIGN PATENT DOCUMENTS

| | | |
|---|---|---|
| JP | 03260574 | 11/1991 |
| JP | 2002022325 | 1/2002 |

(Continued)

OTHER PUBLICATIONS

"REF4P and REF5P and REF5BBP-T Performance Plus Undercounter Refrigerators; Installation, Operation and Service Manual," 01041755R01, Follet Corporation, Jun. 2014.

(Continued)

*Primary Examiner* — Jianying C Atkisson
*Assistant Examiner* — Miguel A Diaz
(74) *Attorney, Agent, or Firm* — Paul & Paul

(57) ABSTRACT

A refrigeration system or a control system for a refrigeration system has a display that by default displays the temperature of a simulated product stored in the refrigeration system as sensed by a temperature probe. The system control logic determines the temperature limits for cutting the refrigeration cycle in or out based on a temperature set-point entered by a user.

14 Claims, 13 Drawing Sheets

(56) References Cited

U.S. PATENT DOCUMENTS 4,123,918 A 11/1978 Kohl et al.
4,169,357 A 10/1979 Kelley
4,248,276 A 2/1981 Gosnell
4,707,684 A 11/1987 Janke et al.
4,796,441 A 1/1989 Goldstein
D299,900 S 2/1989 Marotta
D322,534 S 12/1991 Chaney
RE33,924 E * 5/1992 Valeri ..... A61M 1/0209 210/198.1
5,112,477 A 5/1992 Hamlin
5,125,242 A 6/1992 Von Blanquet
D333,405 S 2/1993 Moyer, Jr. et al.
5,211,030 A 5/1993 Jameson
5,263,332 A * 11/1993 Park ..... F25D 29/00 62/131
5,394,708 A 3/1995 Whinery et al.
5,424,720 A * 6/1995 Kirkpatrick ..... B60H 1/3225 340/585
5,542,573 A 8/1996 Frantz
5,797,514 A 8/1998 Twiggar et al.
5,887,758 A 3/1999 Hawkes et al.
5,950,866 A 9/1999 Lancaster
5,987,900 A 11/1999 Love
6,006,996 A * 12/1999 Bhatnagar ..... G05D 23/1902 236/46 R
D423,861 S 5/2000 Graffius
6,134,908 A 10/2000 Brunner et al.
6,321,802 B1 11/2001 Weeks et al.
6,438,973 B1 * 8/2002 Yoshida ..... F25B 49/005 361/33
6,502,411 B2 * 1/2003 Okamoto ..... F25B 49/00 236/51
6,561,691 B1 5/2003 McCann et al.
6,591,877 B1 7/2003 Graffius
6,685,053 B2 2/2004 Hawkes et al.
6,739,146 B1 * 5/2004 Davis ..... F25D 21/006 62/155
D499,599 S 12/2004 Morrison
6,860,408 B2 3/2005 Hawkes et al.
D510,674 S 10/2005 Smith et al.
D510,675 S 10/2005 Ball
6,952,935 B2 10/2005 Vorosmarti et al.
D515,348 S 2/2006 McWilliam
7,037,428 B1 * 5/2006 Robinson ..... A61M 1/3693 210/360.1
D524,588 S 7/2006 Copland
7,096,686 B2 8/2006 Brunner et al.
7,137,271 B2 11/2006 Hawkes et al.
7,201,005 B2 * 4/2007 Voglewede ..... F25D 23/126 222/146.6
7,263,844 B2 9/2007 Brunner et al.
D551,901 S 10/2007 Hulett et al.
D554,930 S 11/2007 Lavy
D556,494 S 12/2007 Adachi et al.
7,322,201 B2 1/2008 Brunner et al.
D568,913 S 5/2008 Suh et al.
7,415,834 B2 8/2008 Marret et al.
7,426,838 B1 9/2008 Shapiro et al.
D581,716 S 12/2008 Harris, III
7,469,548 B2 12/2008 Brunner et al.
7,469,552 B2 12/2008 Brunner et al.
D589,988 S 4/2009 Martin et al.
7,573,701 B2 * 8/2009 Doberstein ..... F25D 29/005 236/94
D600,062 S 9/2009 Lavy
7,617,690 B2 * 11/2009 Dawes ..... F25D 29/00 62/131
D613,112 S 4/2010 Lippert et al.
D622,533 S 8/2010 Gross et al.
7,814,755 B2 10/2010 Arnold et al.
D627,186 S 11/2010 Romandy
7,878,009 B2 * 2/2011 Doberstein ..... F25D 29/008 340/585
D640,083 S 6/2011 Davenport
D642,851 S 8/2011 Yui
D652,244 S 1/2012 Richardson et al.
8,199,019 B2 * 6/2012 Kaczmarz ..... F25D 29/008 340/5.73
8,464,544 B2 * 6/2013 Shin ..... F25D 11/02 62/157
8,537,018 B2 * 9/2013 Bair ..... F25D 29/008 340/585
D696,350 S 12/2013 d'Amore et al.
D706,567 S 6/2014 Strayle
9,599,384 B2 * 3/2017 Weyna ..... F25B 49/027
9,657,982 B2 * 5/2017 Chou ..... F25D 17/042
9,772,136 B2 * 9/2017 Shim ..... F25D 29/00
2003/0000233 A1 * 1/2003 Mazereeuw ..... F25D 29/00 62/126
2004/0008752 A1 * 1/2004 Prabhakar ..... G01K 1/022 374/102
2005/0011205 A1 * 1/2005 Holmes ..... F25D 29/00 62/156
2005/0039469 A1 * 2/2005 Nonaka ..... F25B 49/025 62/129
2005/0086952 A1 * 4/2005 Nonaka ..... F25D 11/022 62/129
2005/0235669 A1 * 10/2005 Cho ..... F25D 29/00 62/229
2006/0090482 A1 * 5/2006 Dawes ..... F25D 29/00 62/126
2006/0218958 A1 * 10/2006 Rand ..... F25D 11/022 62/302
2006/0277928 A1 12/2006 McDougal et al.
2006/0277937 A1 12/2006 Schlosser et al.
2007/0012055 A1 * 1/2007 Schenk ..... F25B 49/025 62/208
2007/0277538 A1 * 12/2007 Buck ..... F25B 49/005 62/150
2008/0011000 A1 1/2008 Brunner et al.
2008/0022711 A1 1/2008 Brunner et al.
2008/0053119 A1 * 3/2008 Doberstein ..... F25D 29/00 62/157
2008/0059003 A1 * 3/2008 Doberstein ..... F25D 29/008 700/300
2008/0092566 A1 * 4/2008 Rand ..... F25B 41/067 62/115
2008/0130203 A1 * 6/2008 Doberstein ..... F25D 29/005 361/601
2008/0196422 A1 8/2008 Lee et al.
2009/0093917 A1 * 4/2009 Smith ..... F25B 49/005 700/300
2009/0132090 A1 * 5/2009 Kaczmarz ..... F25D 29/008 700/275
2009/0241782 A1 10/2009 Van Dillen et al.
2009/0248218 A1 * 10/2009 Dyrmose ..... F25D 29/003 700/300
2009/0254220 A1 * 10/2009 Shin ..... F25D 11/02 700/275
2010/0070213 A1 * 3/2010 Anklam ..... H02J 13/0062 702/60
2010/0235013 A1 * 9/2010 Suzuki ..... F25B 49/022 700/300
2010/0326106 A1 * 12/2010 Hsu ..... F25B 49/027 62/203
2011/0132007 A1 * 6/2011 Weyna ..... F25B 49/027 62/115
2011/0304466 A1 * 12/2011 Bair ..... F25D 29/008 340/585
2013/0047630 A1 * 2/2013 Lu ..... F25B 21/02 62/3.6
2013/0067940 A1 * 3/2013 Shim ..... F25B 49/005 62/125
2013/0086933 A1 * 4/2013 Holtkamp ..... F25D 29/00 62/129
2013/0145460 A1 * 6/2013 Dudley ..... F25D 29/003 726/21
2013/0339894 A1 * 12/2013 Bair ..... F25D 29/008 715/772

(56) References Cited

U.S. PATENT DOCUMENTS

| | | | | |
|---|---|---|---|---|
| 2014/0070951 | A1* | 3/2014 | Shim | F25D 29/00 340/585 |
| 2014/0101589 | A1* | 4/2014 | Hyun | F25D 29/00 715/769 |
| 2014/0121557 | A1* | 5/2014 | Gannon | A61B 5/002 600/549 |
| 2014/0165614 | A1* | 6/2014 | Manning | F25D 29/00 62/62 |
| 2014/0180483 | A1* | 6/2014 | Cheng | G05D 23/1931 700/278 |
| 2016/0078176 | A1* | 3/2016 | Ranta | A61F 13/42 705/2 |
| 2016/0232877 | A1* | 8/2016 | Cho | F25D 29/005 |
| 2017/0363349 | A1* | 12/2017 | McHale | F25D 29/003 |

FOREIGN PATENT DOCUMENTS

| | | |
|---|---|---|
| JP | 2006242453 | 9/2006 |
| JP | 2006308129 | 11/2006 |

OTHER PUBLICATIONS

"FZR4P and FZR5P and FZR5PLP-T Performance Plus Undercounter Freezers; Installation, Operation and Service Manual," 01041763R01, Follet Corporation, Jun. 2014.

"Performance Plus Undercounter Medical-Grade Freezer Models," https://www.follettice.com/products/medical-grade-freezers/performance-plus-undercounter-medical-grade-freezer/performance-plus-undercounter-medical-gr . . . , Follett Corporation, Mar. 11, 2015.

"Performance Plus Undercounter Medical-Grade Freezer Accessories," https://www.follettice.com/products/medical-grade-freezers/performance-plus-undercounter-medical-grade-freezer/performance-plus-undercounter-medical-gr . . . , Follett Corporation, Mar. 11, 2015.

"Performance Plus Undercounter Medical-Grade Freezer Features," https://www.follettice.com/products/medical-grade-freezers/performance-plus-undercounter-medical-grade-freezer/performance-plus-undercounter-medical-gr . . . , Follett Corporation, Mar. 11, 2015.

"REF1/REF2 High-Performance Compact Refrigerators; Installation, Operation and Service Manual," 00940593R05, Follett Corporation, Mar. 2014.

"REF4P ADA-Compatible Performance Plus, medical-grade undercounter refrigerator," Form #6455 Nov. 2014, Follett Corporation, 2014.

"REF4P-T ADA-Compatible Performance Plus, medical-grade undercounter refrigerator," Form #6505 Nov. 2014, Follett Corporation, 2014.

"Follett Performance Plus' The next level of control in undercounter refrigeration," Form #6500, Follett Corporation, Oct. 2014.

"FZR4P ADA-Compatible Performance Plus, medical-grade undercounter freezer," Form #6465 Jun. 2014, Follett corporation, 2014.

"FZR5P Performance Plus, medical-grade undercounter freezer," Form #6470 Feb. 2015, Follett Corporation, 2014.

http://www.quenchonline.com/water-cooler-products, Quench 975, May 5, 2012.

* cited by examiner

REFRIGERATION SYSTEM AND CONTROL SYSTEM THEREFOR

BACKGROUND OF THE INVENTION

1. Field of the Invention

The present invention relates to refrigerators, freezers, and their control systems for safe storage of organs for transplant, blood, and other temperature sensitive biological or medical materials.

2. Brief Description of the Prior Art

Refrigeration systems for storing sensitive medical or biological materials in a temperature controlled environment are known. An example of this type of refrigeration system can be seen in U.S. Pat. No. 8,199,019, issued to Kenneth A. Kaczmarz et al. on Jun. 12, 2012. Refrigeration system monitoring and alarm devices and systems are shown in U.S. Pat. No. 7,814,755, issued to Friedrich Arnold et al. on Oct. 19, 2010, U.S. Pat. No. 4,707,684, issued to Donald E. Janke et al. on Nov. 17, 1987, and U.S. Pat. No. 4,169,357, issued to Joseph B. Kelley on Oct. 2, 1979. A refrigerator defrosting system is shown in U.S. Pat. No. 4,074,987, issued to Edward B. Krulewich on Feb. 21, 1978. However, none of the prior art refrigeration systems are seen to provide the accuracy of temperature control combined with the ease of use and the capability to meet the most stringent requirements of governmental and other regulatory bodies that are offered by the present invention.

SUMMARY OF THE INVENTION

The present invention is directed to a refrigeration system for storage of temperature sensitive medications, biological samples and cultures, organs and tissues for transplantation, and biological fluids including, for example, blood and blood products. The present invention also encompasses a control system for such a refrigeration system. These types of refrigeration systems are subject to regulations from the Centers for Disease Control (CDC) and other agencies, for example, for vaccine storage, the American Association of Blood Banks (AABB) for blood storage, and countless other regulatory agencies.

The refrigeration system of the present invention includes an enclosure including a door to provide an enclosed space while allowing user access to the interior of the enclosed space. The refrigeration system of the present invention is a commercial grade system suitable for use in the healthcare industry and capable of meeting the most demanding requirements of that industry. The refrigeration system of the present invention is preferably of stainless steel construction. The refrigeration system of the present invention refrigerator preferably has a storage volume in the range of 3 to 5 cubic feet and is capable of reliably maintaining temperature within 1 degree Centigrade. Exemplary embodiments of the refrigeration system of the present invention have storage volumes of 3.9, 4, 4.5, and 5 cubic feet; however, the control system of the present invention may be applied to any size refrigeration system. The refrigeration system of the present invention utilizes a forced air cooling method to maintain an even airflow distribution and more uniform temperature profile.

The refrigeration system of the present invention includes a condensing unit and an evaporator unit. Condensing unit and condenser are used interchangeably herein. Evaporator unit and evaporator are used interchangeably herein. Temperature control is achieved with a programmable control system utilizing two or more temperature probes or sensors.

The refrigeration system of the present invention is provided with user configurable shelves and drawers.

The refrigeration system of the present invention provides tight temperature control and monitoring, high and low temperature alarms, data logging, battery backup systems, and the ability to customize these systems to fit customer needs. The refrigeration system of the present invention displays actual product temperature or simulated product temperature, which are more accurate representations of the actual temperature of the items stored in the refrigeration system than the air temperature within the enclosure of the refrigeration system. The air temperature is more prone to relatively wide swings due to, for example, the refrigeration system door being opened, while the actual product temperature remains relatively more stable. Displaying the actual product temperature or the simulated product temperature reduces the likelihood of customer confusion as to why the refrigeration system is not holding a steady temperature when in fact it is.

Embodiments of the refrigeration system of the present invention can be made as a refrigerator or as a freezer. The control system of the present invention allows the user to select the set-point for the temperature in the enclosure of the refrigeration system. The set-point can be set to a temperature in the range of −37 to 10 degrees centigrade. The temperature inside the enclosure of the refrigeration system is preferably maintained within ±2.2° C. (4° F.) of the set-point, and more preferably within ±1° C. (1.8° F.), even with frequent door openings. The temperature inside the enclosure of the refrigeration system is maintained within the aforesaid ranges regardless of the selected set-point temperature. In the refrigerator embodiment, the set-point can preferably be set to a temperature in the range of 2° C. to 10° C. (36° F. to 50° F.). In the freezer embodiment, the set-point can preferably be set to a temperature in the range of −37° C. to −17° C. (−35° F. to 1.8° F.). In the freezer embodiment, the set-point can more preferably be set to a temperature in the range of −37° C. to −18° C. (−35° F. to 0° F.).

The present invention also includes a control system that incorporates all of the above features, and can be applied to the control of any refrigeration system. The control system of the present invention, and in turn the refrigeration system of the present invention, also incorporates an integral data logger for temperature monitoring and reporting.

It is an aspect of the present invention to provide a refrigeration system that comprises:

an enclosure including a left wall, a right wall, a back wall, a top, and a bottom, the enclosure having a front opening, the front opening having a left side and a right side;

the enclosure also including a door adapted to act as a closure for the front opening, the door having a left side surface and a right side surface;

an upper hinge having a first hinge portion and a second hinge portion that are adapted to be pivotally connected to one another;

a lower hinge having a first hinge portion and a second hinge portion that are adapted to be pivotally connected to one another;

a control system for controlling the operation of the refrigeration system;

a façade housing at least a portion of the control system, the façade having a left side and a right side, the façade having a molded-in left cut-out on the left side thereof, the façade having a molded-in right cut-out on the right side thereof, and the façade having a molded-in handle, wherein the left side of the front opening has upper mounting points for the first hinge portion of the upper hinge and the left side of the front opening has lower mounting points for the first hinge portion of the lower hinge, wherein the right side of the front opening has upper mounting points for the first hinge portion of the upper hinge and the right side of the front opening has lower mounting points for the first hinge portion of the lower hinge, wherein the left side surface of the door has upper mounting points for the second hinge portion of the upper hinge and the left side surface of the door has lower mounting points for the second hinge portion of the lower hinge, and wherein the right side surface of the door has upper mounting points for the second hinge portion of the upper hinge and the right side surface of the door has lower mounting points for the second hinge portion of the lower hinge, to thereby allow the door to open either on the left side thereof or on the right side thereof on a field-selectable basis, and wherein the left cut-out provides clearance for at least part of the upper hinge when the door is hinged on the left side surface thereof, and wherein the right cut-out provides clearance for at least part of the upper hinge when the door is hinged on the right side surface thereof.

It is another aspect of the present invention to provide a refrigeration system having at least one bracket covered by a façade having a molded-in handle and connecting the façade to the door of the refrigeration system such that a pull force applied to the molded-in handle is transmitted to the door via the at least one bracket.

It is still another aspect of the present invention to provide a refrigeration system including a façade with a molded-in handle wherein a bracket connects the façade to the door of the refrigeration system, and wherein the bracket comprises a back plate comprising a rectangular base portion and a pair of extensions each located at either end of the rectangular base portion, each of the pair of extensions having a top flange extending perpendicularly from a top end thereof, each the top flange having attachment means for attachment of the façade to the bracket, a bottom flange extending perpendicularly from a bottom edge of the rectangular base portion, the bottom flange having attachment means for attachment of the façade to the bracket at each end thereof, and a handle support plate extending below the bottom flange from an edge of the bottom flange distal from the rectangular base plate, the handle support plate being in contact with a back side of a portion of the molded-in handle adapted for engagement by a user's hand or fingers when the user applies a pulling force to open the door such that the bracket will bear and transmit the pulling force to the door without any damaging stress being applied to the façade or the molded-in handle thereof.

It is yet another aspect of the present invention to provide a refrigeration system having a façade with a molded-in handle, wherein the door of the refrigeration system has a width measured from the left side surface of the door to the right side surface of the door and wherein the molded-in handle extends in a left-to-right direction over a majority of the width of the door.

In another aspect of the invention, the refrigeration system further includes a display for displaying at least the temperature of a product or a simulated product inside the enclosure to a user, wherein the display is supported by the façade at an ergonomically appropriate acute angle relative to a vertical plane for comfortable viewing by the user.

In another aspect of the invention, the refrigeration system further includes a bottom cap adapted to route a cable from the display or display controller to a user selectable one of a left side of said door and a right side of said door depending upon the door being hinged to the front opening at the left side of the door or at the right side of the door.

It is yet another aspect of the present invention to provide a control system for controlling temperature within an enclosure of a refrigeration system having an evaporator and means for forced air circulation through the evaporator, the control system comprising:

a microcomputer at least controlling the means for forced air circulation;

a first temperature sensor communicating with the microcomputer, the first temperature sensor being located in a place selected from an air intake stream to the evaporator and directly on the evaporator itself;

a second temperature sensor communicating with the microcomputer, the second temperature sensor being in contact with one of a simulated product and an actual product placed within the enclosure;

user interface means to allow a user to program the control system with one or more temperature control parameters;

a door opening sensor communicating with the microcomputer; and alarm means for generating an alarm to alert a user when a temperature sensed by the second temperature sensor is outside a desired temperature range that is based upon the one or more temperature control parameters, wherein the microcomputer determines upper and lower temperature limits based upon the one or more temperature control parameters, the control system operates the refrigeration system to cool the interior of the enclosure of the refrigeration system when a temperature sensed using the first temperature sensor is at or above the upper temperature limit, the control system stops operation of the refrigeration system to cool the interior of the enclosure of the refrigeration system when the temperature sensed using the first temperature sensor reaches the lower temperature limit, wherein the microcomputer at least stops operation of the means for forced air circulation when door opening is detected while the control system is operating the refrigeration system to cool the interior of the enclosure of the refrigeration system, and wherein the control system operates the refrigeration system to cool the interior of the enclosure of the refrigeration system when, after door closing is detected, the temperature sensed using the first temperature sensor is at or above the upper temperature limit, and wherein the microcomputer logs temperature readings from the first and second temperature sensors at predetermined or user selected intervals of time.

It is yet another aspect of the present invention to provide a control system for controlling temperature within an enclosure of a refrigeration system, wherein the temperature control parameters include a temperature set-point selected by the user.

It is yet another aspect of the present invention to provide a control system for controlling temperature within an enclosure of a refrigeration system, wherein the temperature control parameters include a user selectable temperature set-point, and wherein the control system logic implemented using the microcomputer determines or selects upper and lower temperature limits, also known as cut-in and cut-out temperatures, to start and stop the cooling cycle of the refrigeration system.

It is yet another aspect of the present invention to provide a control system for controlling temperature within an enclosure of a refrigeration system, wherein the temperature control parameters include a user selectable temperature set-point, and wherein the control system operates to maintain the temperature sensed by a temperature sensor inside the enclosure within a desired range, which is ±2.2° C. of the temperature set-point.

It is yet another aspect of the present invention to provide a control system for controlling temperature within an enclosure of a refrigeration system, wherein the temperature control parameters include a user selectable temperature set-point, and wherein the control system operates to maintain the temperature sensed by a temperature sensor inside the enclosure within a desired range, which is ±1° C. of the temperature set-point.

It is yet another aspect of the present invention to provide a control system for controlling temperature within an enclosure of a refrigeration system, wherein the temperature control parameters include a user selectable temperature set-point, and wherein the control system operates to maintain the temperature sensed by a product temperature sensor inside the enclosure within a desired range.

It is yet another aspect of the present invention to provide a control system for controlling temperature within an enclosure of a refrigeration system, wherein the temperature control parameters include a user selectable temperature set-point, and wherein the control system operates to maintain the temperature sensed by a product temperature sensor inside the enclosure within a desired range, which is ±2.2° C. of the temperature set-point.

It is yet another aspect of the present invention to provide a control system for controlling temperature within an enclosure of a refrigeration system, wherein the temperature control parameters include a user selectable temperature set-point, and wherein the control system operates to maintain the temperature sensed by a product temperature sensor inside the enclosure within a desired range, which is ±1° C. of the temperature set-point.

It is yet another aspect of the present invention to provide a control system for controlling temperature within an enclosure of a refrigeration system, wherein the temperature control parameters include a user selectable temperature set-point, and wherein the control system operates to maintain the temperature sensed by a simulated product temperature sensor inside the enclosure within a desired range.

It is yet another aspect of the present invention to provide a control system for controlling temperature within an enclosure of a refrigeration system, wherein the temperature control parameters include a user selectable temperature set-point, and wherein the control system operates to maintain the temperature sensed by a simulated product temperature sensor inside the enclosure within a desired range, which is ±2.2° C. of the temperature set-point.

It is yet another aspect of the present invention to provide a control system for controlling temperature within an enclosure of a refrigeration system, wherein the temperature control parameters include a user selectable temperature set-point, and wherein the control system operates to maintain the temperature sensed by a simulated product temperature sensor inside the enclosure within a desired range, which is ±1° C. of the temperature set-point.

It is yet another aspect of the present invention to provide a control system for controlling temperature within an enclosure of a refrigeration system, wherein the control system includes a microcomputer, the evaporator of the refrigeration system has a temperature, and the control system further comprises:

a defrost heater communicating with the microcomputer;

a third temperature sensor communicating with the microcomputer, the third temperature sensor being positioned to monitor the temperature of the evaporator, wherein the microcomputer operates to turn the defrost heater on based upon a temperature sensed by the third temperature sensor.

It is yet another aspect of the present invention to provide a control system for controlling temperature within an enclosure of a refrigeration system, wherein the refrigeration system further comprises a compressor having an inlet and an outlet, the control system further comprising:

a fourth temperature sensor provided upstream of the inlet to the compressor, the fourth temperature sensor communicating with the microcomputer, the microcomputer generating a system alert when a temperature sensed by the fourth temperature sensor falls to or below a predetermined temperature corresponding to an unacceptably high probability that liquid may be slugging into the compressor, which may cause compressor damage.

It is yet another aspect of the present invention to provide a control system for controlling temperature within an enclosure of a refrigeration system, wherein the refrigeration system further comprises a compressor having an inlet and an outlet, the control system further comprising:

a fourth temperature sensor provided upstream of the inlet to the compressor, the fourth temperature sensor communicating with the microcomputer, the microcomputer generating a system alert when a temperature sensed by the fourth temperature sensor falls to or below about 5° F. corresponding to an unacceptably high probability that liquid may be slugging into the compressor, which may cause compressor damage.

It is yet another aspect of the present invention to provide a control system for controlling temperature within an enclosure of a refrigeration system, wherein the refrigeration system further comprises a compressor having an inlet and an outlet, the control system further comprising:

a fourth temperature sensor provided upstream of the inlet to the compressor, the fourth temperature sensor communicating with the microcomputer, the microcomputer generating a system alert when a temperature sensed by the fourth temperature sensor falls to or below a temperature selected from the range of −100 to 100° F.

It is yet another aspect of the present invention to provide a control system for controlling temperature within an enclosure of a refrigeration system that has a façade, wherein the control system further comprises a display supported by the façade, and wherein the display can be operated to display the temperature measured using a first temperature sensor.

It is yet another aspect of the present invention to provide a control system for controlling temperature within an enclosure of a refrigeration system that has a façade, wherein the control system further comprises a display supported by the façade, and wherein the display can be operated to display the temperature measured using a second temperature sensor.

It is yet another aspect of the present invention to provide a control system for controlling temperature within an enclosure of a refrigeration system that has a façade, wherein the control system further comprises a display supported by the façade, and wherein the display can be operated to display the temperature measured by an air temperature sensor.

It is yet another aspect of the present invention to provide a control system for controlling temperature within an enclosure of a refrigeration system that has a façade, wherein the control system further comprises a display supported by the façade, and wherein the display can be operated to display the temperature measured by a product temperature sensor.

It is yet another aspect of the present invention to provide a control system for controlling temperature within an enclosure of a refrigeration system that has a façade, wherein the control system further comprises a display supported by the façade, and wherein the display can be operated to display the temperature measured by a simulated product temperature sensor.

It is yet another aspect of the present invention to provide a control system for controlling temperature within an enclosure of a refrigeration system that has a façade, wherein the control system further comprises a display supported by the façade, and wherein the display by default displays the temperature measured by a product or simulated product temperature sensor.

It is yet another aspect of the present invention to provide a control system for controlling temperature within an enclosure of a refrigeration system that has a façade, wherein the control system further comprises a display supported by the façade, and wherein the display by default displays the temperature measured by a simulated product temperature sensor.

It is yet another aspect of the present invention to provide a control system for controlling temperature within an enclosure of a refrigeration system, further comprising a simulated product located within the enclosure, the simulated product having a heat capacity and heat transfer coefficient approximating those of actual products that are to be kept in the enclosure, wherein a second temperature sensor senses the temperature of the simulated product.

It is yet another aspect of the present invention to provide a control system for controlling temperature within an enclosure of a refrigeration system, wherein the simulated product comprises a bottle and a liquid at least in part filling the bottle and wherein the second temperature sensor is positioned in the liquid.

It is yet another aspect of the present invention to provide a control system for controlling temperature within an enclosure of a refrigeration system, further comprising a simulated product comprising a bottle and a liquid at least in part filling the bottle and wherein the liquid is glycerin.

It is yet another aspect of the present invention to provide a control system for controlling temperature within an enclosure of a refrigeration system including a compressor, wherein the control system includes a microcomputer and further comprises:

a fifth temperature sensor provided downstream of the compressor to monitor a compressor discharge temperature, the fifth temperature sensor communicating with the microcomputer, the microcomputer monitoring the compressor discharge temperature, the microcomputer operating to shut down the refrigeration system when the compressor discharge temperature exceeds a predetermined value for the compressor discharge temperature.

It is yet another aspect of the present invention to provide a control system for controlling temperature within an enclosure of a refrigeration system including a compressor, wherein the control system includes a microcomputer and further comprises:

a fifth temperature sensor provided downstream of the compressor to monitor a compressor discharge temperature, the fifth temperature sensor communicating with the microcomputer, the microcomputer monitoring the compressor discharge temperature, the microcomputer operating to shut down the refrigeration system when the compressor discharge temperature exceeds a predetermined value of about 230° F. to about 250° F. for the compressor discharge temperature.

It is yet another aspect of the present invention to provide a control system for controlling temperature within an enclosure of a refrigeration system including a compressor, wherein the control system includes a microcomputer and further comprises:

a fifth temperature sensor provided downstream of the compressor to monitor a compressor discharge temperature, the fifth temperature sensor communicating with the microcomputer, the microcomputer monitoring the compressor discharge temperature, the microcomputer operating to shut down the refrigeration system when the compressor discharge temperature exceeds a predetermined value in the range of 100° F. to 250° F. for the compressor discharge temperature.

It is yet another aspect of the present invention to provide a control system for controlling temperature within an enclosure of a refrigeration system, wherein the refrigeration system further comprises a compressor having an inlet and an outlet, a condenser, and a condenser air inlet, the control system including a microcomputer and further comprising:

a fourth temperature sensor provided upstream of the inlet to the compressor, the fourth temperature sensor communicating with the microcomputer;

a fifth temperature sensor provided downstream of the compressor to monitor a compressor discharge temperature, the fifth temperature sensor communicating with the microcomputer, the microcomputer monitoring the compressor discharge temperature; and a sixth temperature sensor provided to monitor temperature in the condenser air inlet, the sixth temperature sensor communicating with the microcomputer, the microcomputer generating a system alert that maintenance may be required when the temperatures sensed by the fourth, fifth, and sixth temperature sensors together are indicative of an abnormal condition in the refrigeration system.

It is yet another aspect of the present invention to provide a control system for controlling temperature within an enclosure of a refrigeration system, wherein the control system includes a microcomputer and further comprises a seventh temperature sensor communicating with the microcomputer, the seventh temperature sensor being in contact with one of a simulated product and an actual product placed within the enclosure, wherein the microcomputer logs temperature readings from the seventh temperature sensor at predetermined intervals of time.

It is yet another aspect of the present invention to provide a control system for controlling temperature within an enclosure of a refrigeration system, wherein the control system includes a microcomputer and further comprises a eighth temperature sensor communicating with the microcomputer, the eighth temperature sensor being in contact with one of a simulated product and an actual product placed within the enclosure, wherein the microcomputer logs temperature readings from the eighth temperature sensor at predetermined or user selected intervals of time.

It is yet another aspect of the present invention to provide a control system for controlling temperature within an enclosure of a refrigeration system, wherein the control system includes a microcomputer and further comprises one or more additional temperature sensors communicating with the microcomputer, the one or more additional temperature sensors each being in contact with a respective one of a simulated product and an actual product placed within the enclosure, wherein the microcomputer logs temperature readings from the one or more additional temperature sensors at predetermined or user selected intervals of time.

It is yet another aspect of the present invention to provide a control system for controlling temperature within an enclosure of a refrigeration system, wherein the control system includes a microcomputer and further comprises one or more additional temperature sensors communicating with the microcomputer, the one or more additional temperature sensors each being in contact with a respective simulated product placed within the enclosure, wherein the microcomputer logs temperature readings from the one or more additional temperature sensors at predetermined or user selected intervals of time.

It is yet another aspect of the present invention to provide a control system for controlling temperature within an enclosure of a refrigeration system, wherein the control system includes a microcomputer and further comprises one or more additional temperature sensors communicating with the microcomputer, the one or more additional temperature sensors each being in contact with a respective actual product placed within the enclosure, wherein the microcomputer logs temperature readings from the one or more additional temperature sensors at predetermined or user selected intervals of time.

It is yet another aspect of the present invention to provide a control system for controlling temperature within an enclosure of a refrigeration system, wherein the microcomputer operates to turn the defrost heater off based upon one of a temperature sensed by the third temperature sensor and a predetermined or user selected duration.

It is yet another aspect of the present invention to provide a control system for controlling temperature within an enclosure of a refrigeration system, wherein the control system further includes a defrost heater communicating with the microcomputer, wherein the microcomputer operates to turn the defrost heater on at predetermined or user selected intervals of time for a predetermined or user selected duration.

It is yet another aspect of the present invention to provide a control system for controlling temperature within an enclosure of a refrigeration system, wherein the temperature control parameters include a user selectable temperature set-point selected from a range of −37 to 10 degrees centigrade.

It is yet another aspect of the present invention to provide a control system for controlling temperature within an enclosure of a refrigeration system, wherein the temperature control parameters include a user selectable temperature set-point selected from a range of 2° C. to 10° C.

It is yet another aspect of the present invention to provide a control system for controlling temperature within an enclosure of a refrigeration system, wherein the temperature control parameters include a user selectable temperature set-point selected from a range of −37° C. to −17° C.

It is yet another aspect of the present invention to provide a control system for controlling temperature within an enclosure of a refrigeration system, wherein the temperature control parameters include a user selectable temperature set-point selected from a range of −37° C. to −18° C.

It is yet another aspect of the present invention to provide a control system for controlling temperature within an enclosure of a refrigeration system, wherein the refrigeration system is a refrigerator.

It is yet another aspect of the present invention to provide a control system for controlling temperature within an enclosure of a refrigeration system, wherein the refrigeration system is a freezer.

It is yet another aspect of the present invention to provide a refrigeration system that provides for flexible set-point control featuring a desired user set-point, with programmable offsets.

It is yet another aspect of the present invention to provide a refrigeration system that has multiple probe inputs for complete system control and monitoring.

It is yet another aspect of the present invention to provide a refrigeration system that displays and monitors multiple product temperatures.

It is yet another aspect of the present invention to provide a refrigeration system that monitors the temperature of a simulated product for high and low temperature excursions.

It is yet another aspect of the present invention to provide a refrigeration system that provides for data logging of system events, probe temperatures and external analog inputs.

It is yet another aspect of the present invention to provide a refrigeration system that has battery backup to ensure at least that its alarm functions continue in operation in the event of a power failure.

It is yet another aspect of the present invention to provide a refrigeration system that provides a low battery level alarm function for its backup battery.

It is yet another aspect of the present invention to provide a refrigeration system that has an integrated keypad entry lock system.

It is yet another aspect of the present invention to provide a refrigeration system having an integral LED display and/or one or more LED lights.

It is yet another aspect of the present invention to provide a refrigeration system that has an integrated door switch for alarming and LED light control.

It is yet another aspect of the present invention to provide a refrigeration system that provides for power loss alarm and monitoring.

It is yet another aspect of the present invention to provide a refrigeration system that has multiple alarm routines.

It is yet another aspect of the present invention to provide a refrigeration system that provides for Centigrade and Fahrenheit unit conversion.

It is yet another aspect of the present invention to provide a refrigeration system having on-screen graph display for quick and convenient visual inspection of temperature performance.

It is yet another aspect of the present invention to provide a refrigeration system having integrated relay outputs for sending notifications to remotely located devices.

It is yet another aspect of the present invention to provide a refrigeration system having a sleep mode for hiding temperature display.

It is yet another aspect of the present invention to provide a refrigeration system that provides for import and export of parameters for ease of programming.

It is yet another aspect of the present invention to provide a control system for a refrigeration system where the control system maintains a product temperature or a simulated product temperature within a predetermined range of a user selected temperature set-point, and with the desired temperature set-point being the only temperature control parameter that the user is required to select and/or enter into the control system.

These and other aspects of the present invention will be apparent in view of the description below and the appended drawings and claims.

DETAILED DESCRIPTION OF THE PREFERRED EMBODIMENTS

Figure 1:
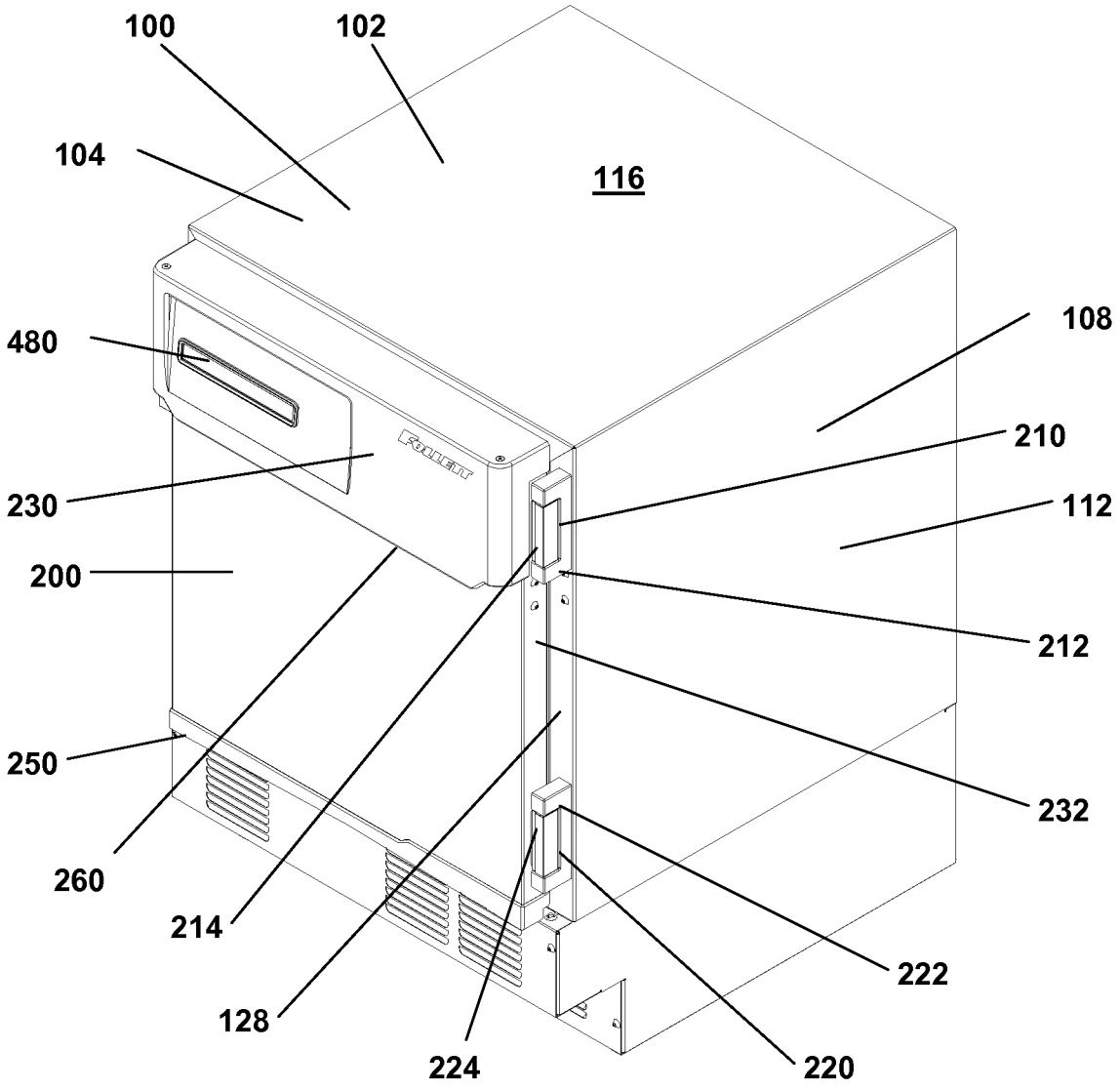
FIG. 1 is a front perspective view of a refrigeration system according to the present invention.
Figure 2:
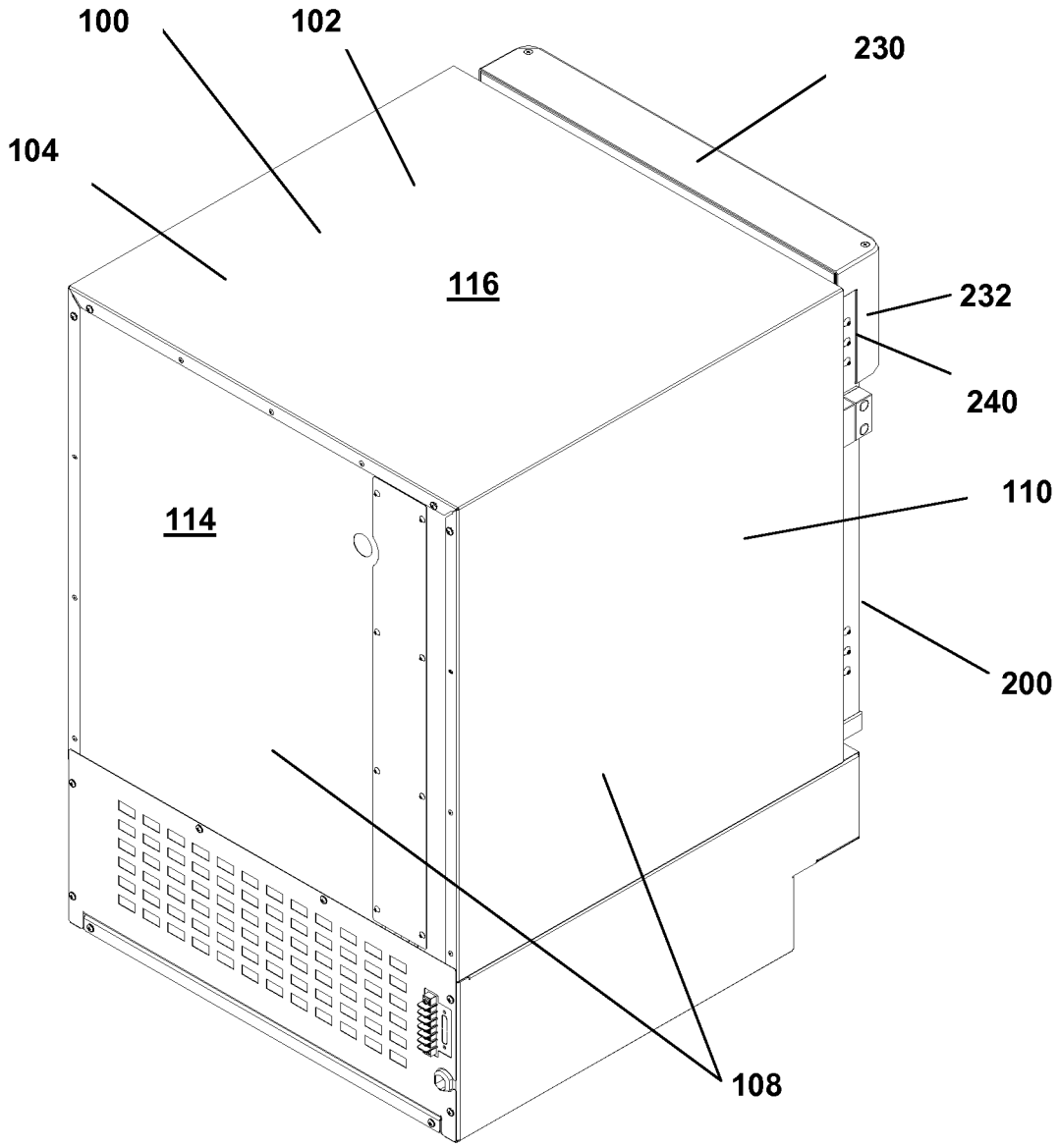
FIG. 2 is a rear perspective view of a refrigeration system according to the present invention.
Figure 3:
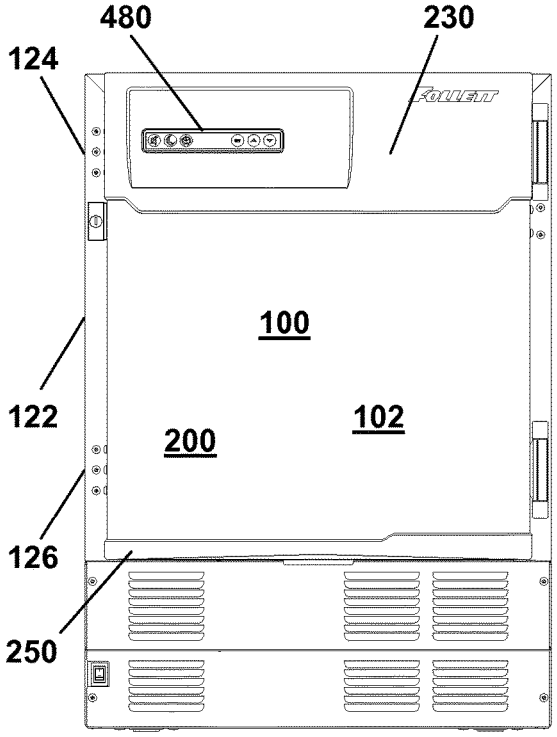
FIG. 3 is a front view of a first embodiment of a refrigeration system according to the present invention.
Figure 4:
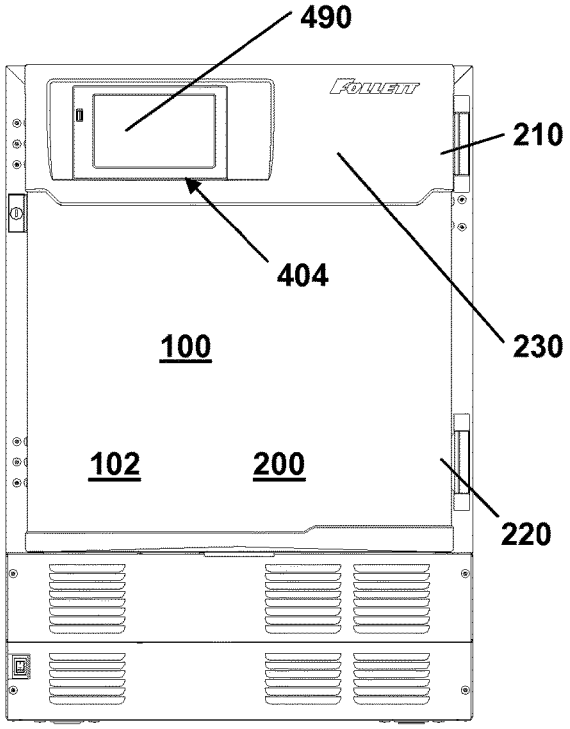
FIG. 4 is a front view of a second embodiment of a refrigeration system according to the present invention.
Figure 5:
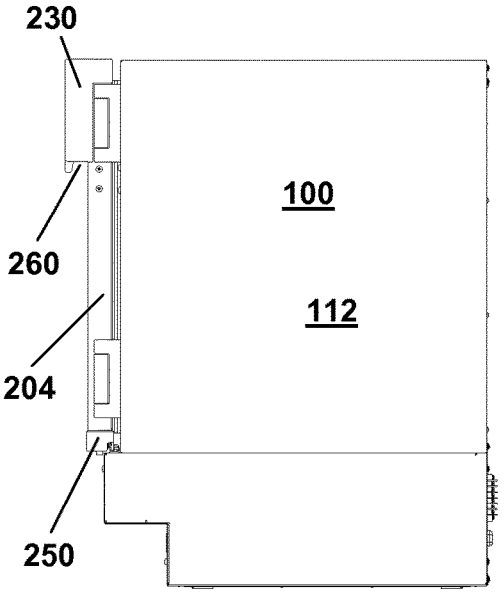
FIG. 5 is a right side view of a refrigeration system according to the present invention.
Figure 6:
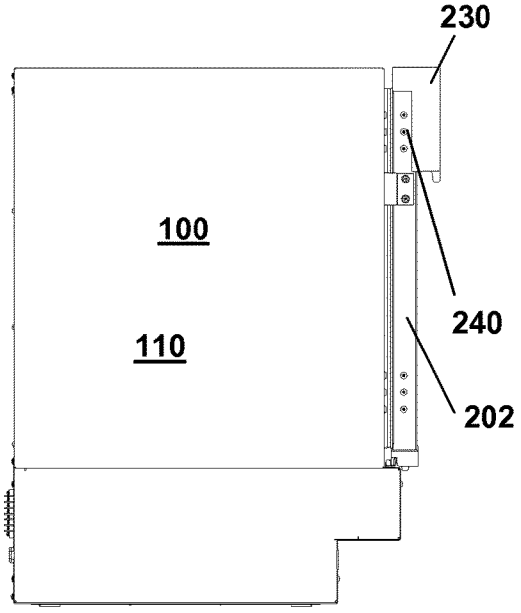
FIG. 6 is a left side view of a refrigeration system according to the present invention.
Figure 7:
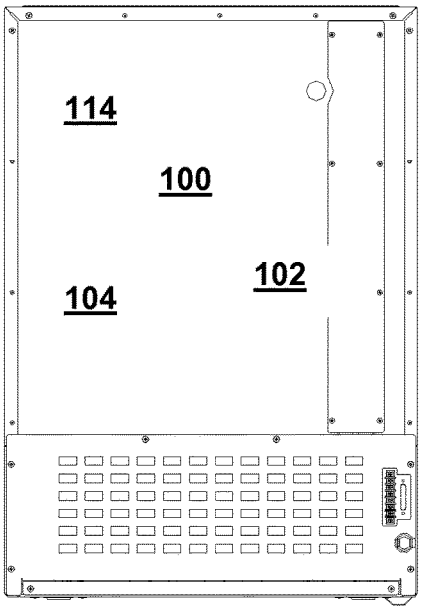
FIG. 7 is a rear view of a refrigeration system according to the present invention.
Figure 8:
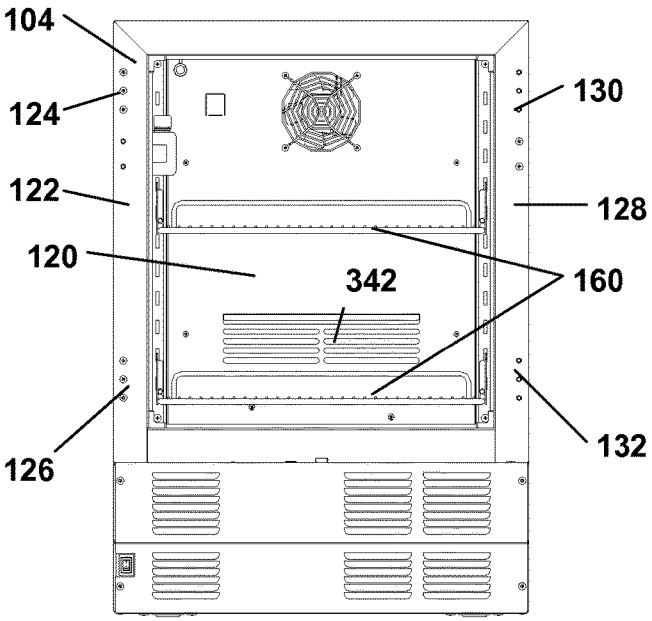
FIG. 8 is a front view of a refrigeration system according to the present invention with the door removed.
Figure 9:
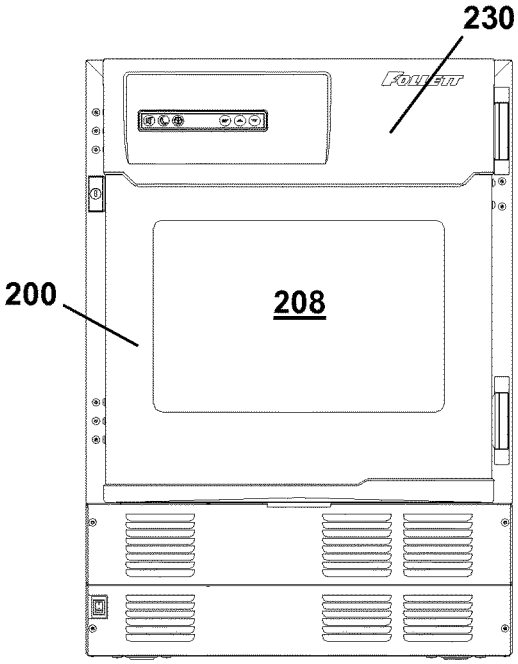
FIG. 9 is a front view of a third embodiment of a refrigeration system according to the present invention.
Figure 10:
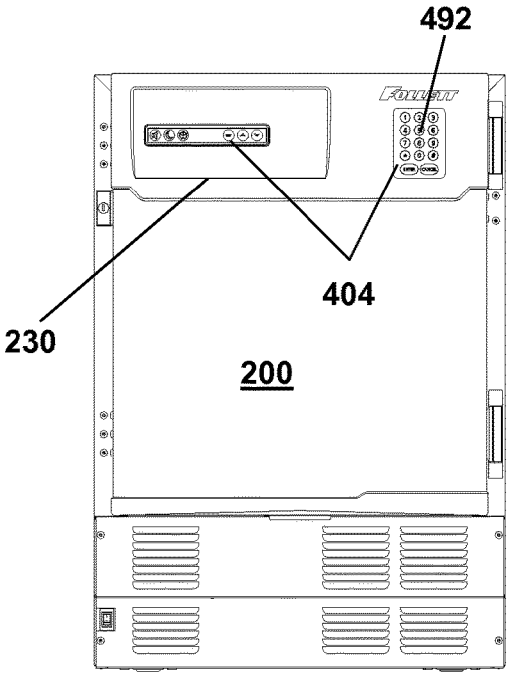
FIG. 10 is a front view of a forth embodiment of a refrigeration system according to the present invention.
Figure 11:
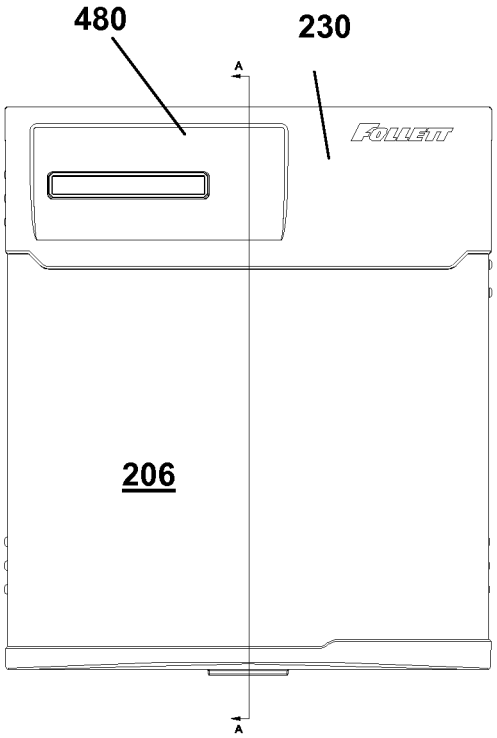
FIG. 11 is a front view of the door of a refrigeration system according to the present invention.
Figure 12:
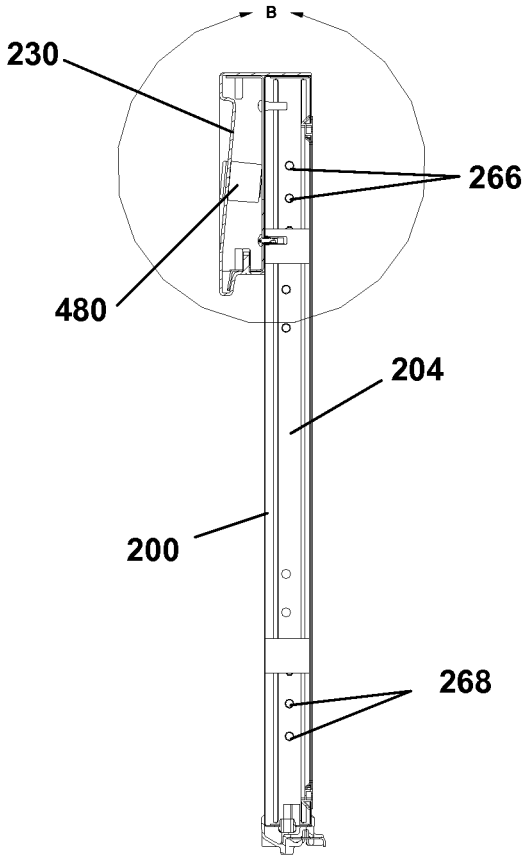
FIG. 12 is a right side view of the door of a refrigeration system according to the present invention with the front façade sectioned.
Figure 13:
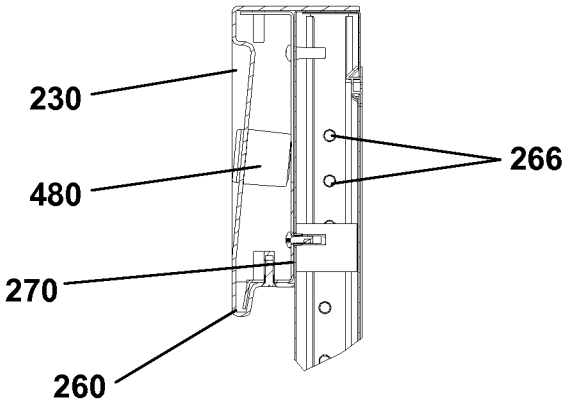
FIG. 13 is an enlargement of the sectioned view of the front façade of a refrigeration system according to the present invention.
Figure 14:
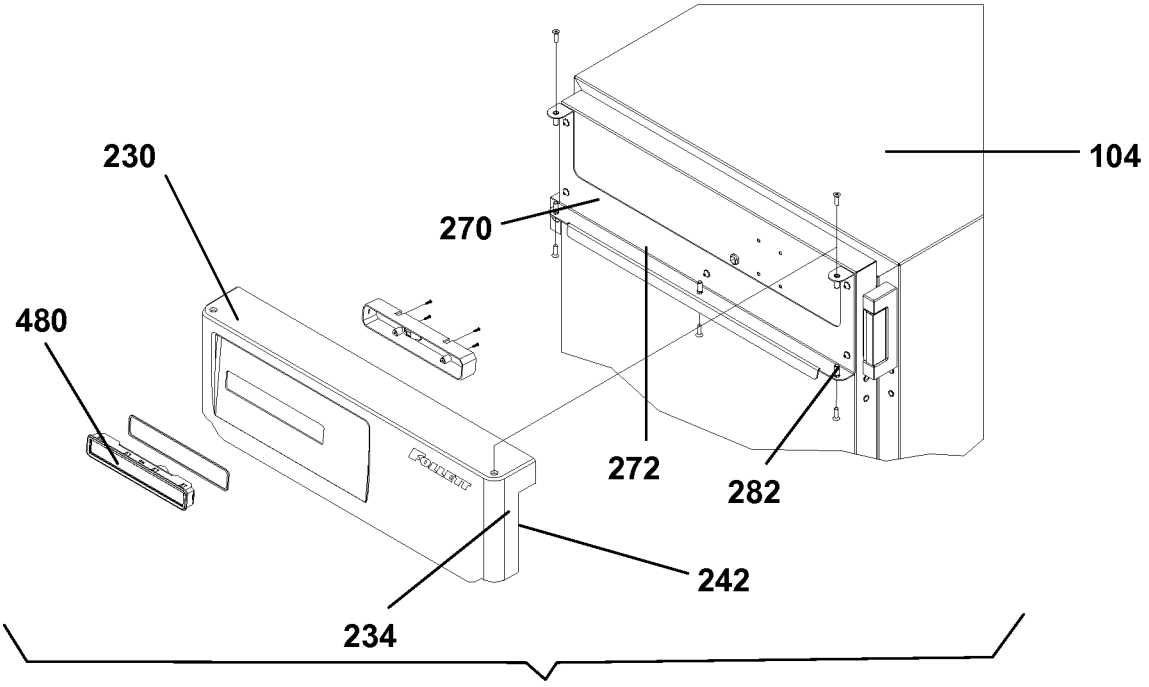
FIG. 14 is an exploded view showing the front façade of a refrigeration system according to the present invention and its mounting bracket.
Figure 15:
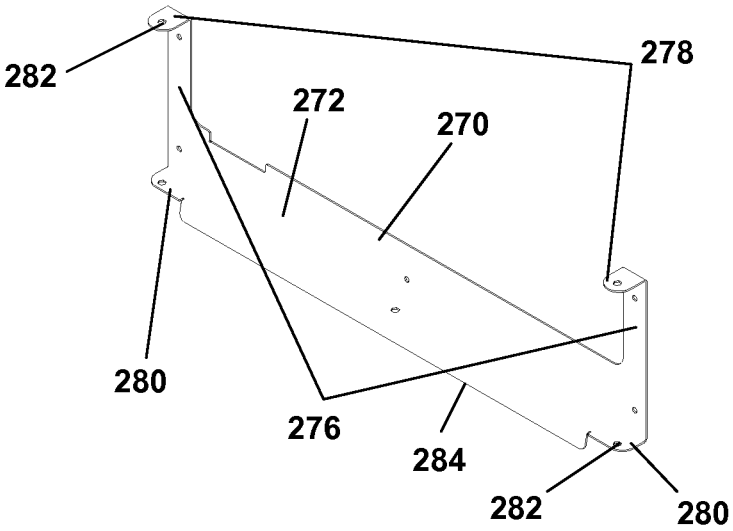
FIG. 15 is a perspective view of the mounting bracket of the front façade of a refrigeration system according to the present invention.
Figure 16:
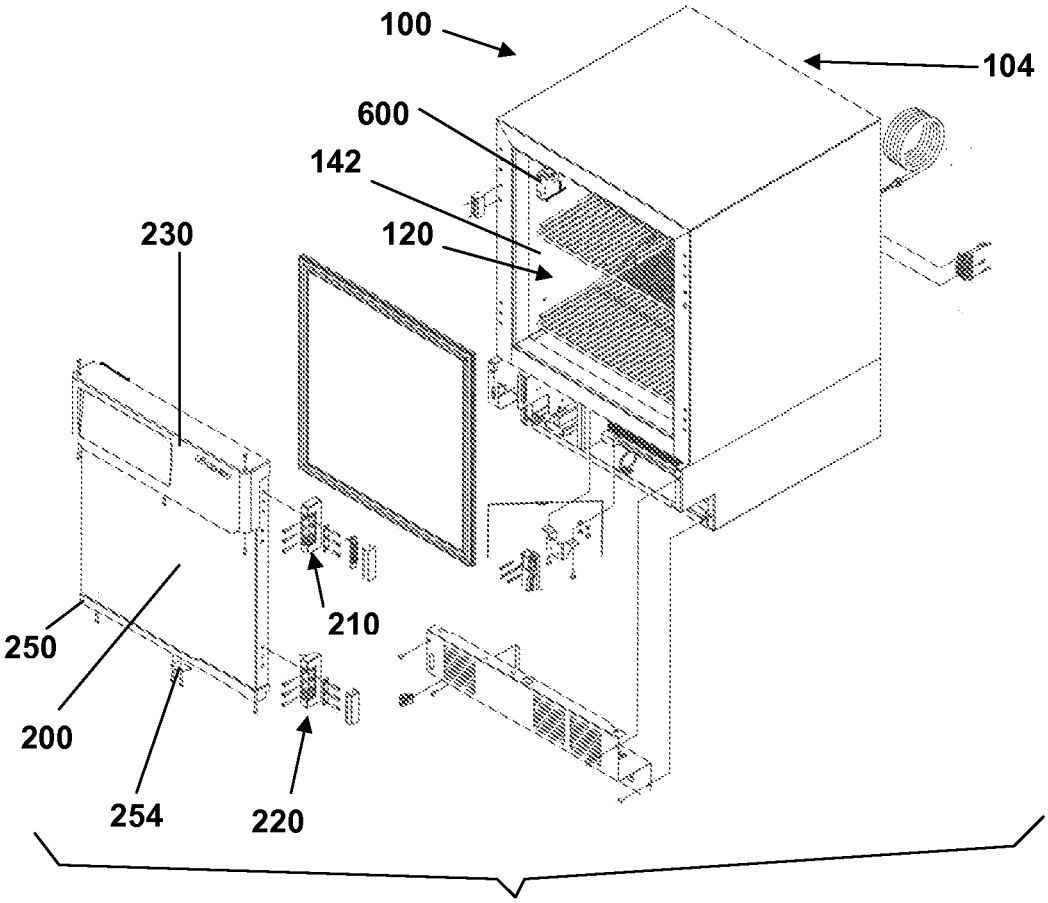
FIG. 16 is an exploded view showing the door separated from the cabinet of a refrigeration system according to the present invention.
Figure 17:
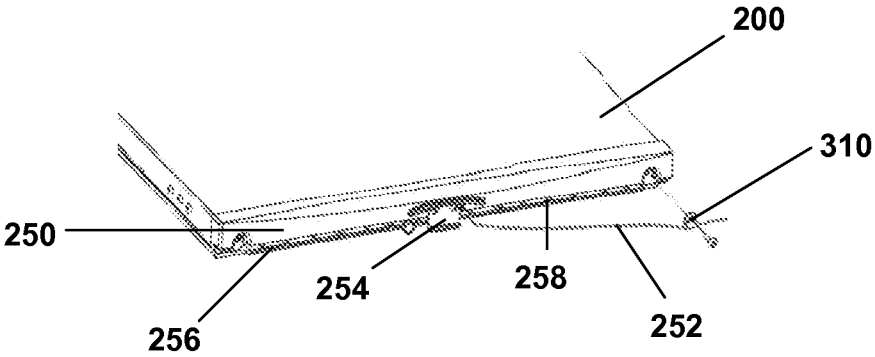
FIG. 17 is a fragmentary view showing the bottom cap of the door of a refrigeration system according to the present invention.
Figure 18:
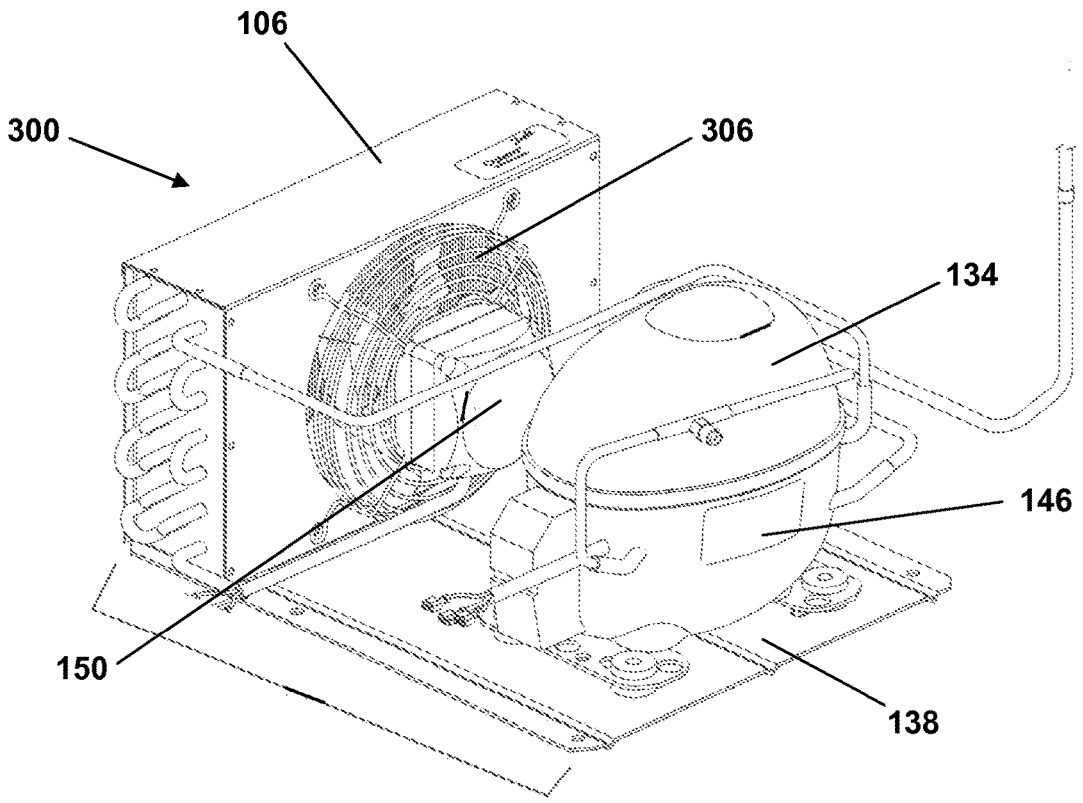
FIG. 18 is a perspective view of the condensing unit of a refrigeration system according to the present invention.
Figure 19:
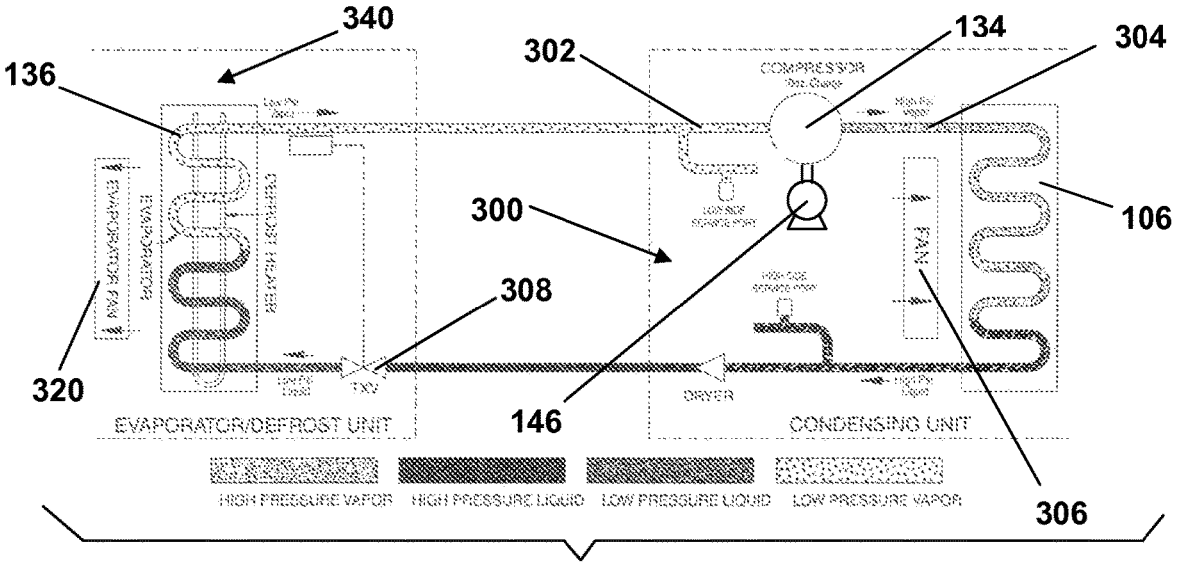
FIG. 19 is a diagrammatic view illustrating the relationship between the condensing unit and the evaporator unit of a refrigeration system according to the present invention.
Figure 20:
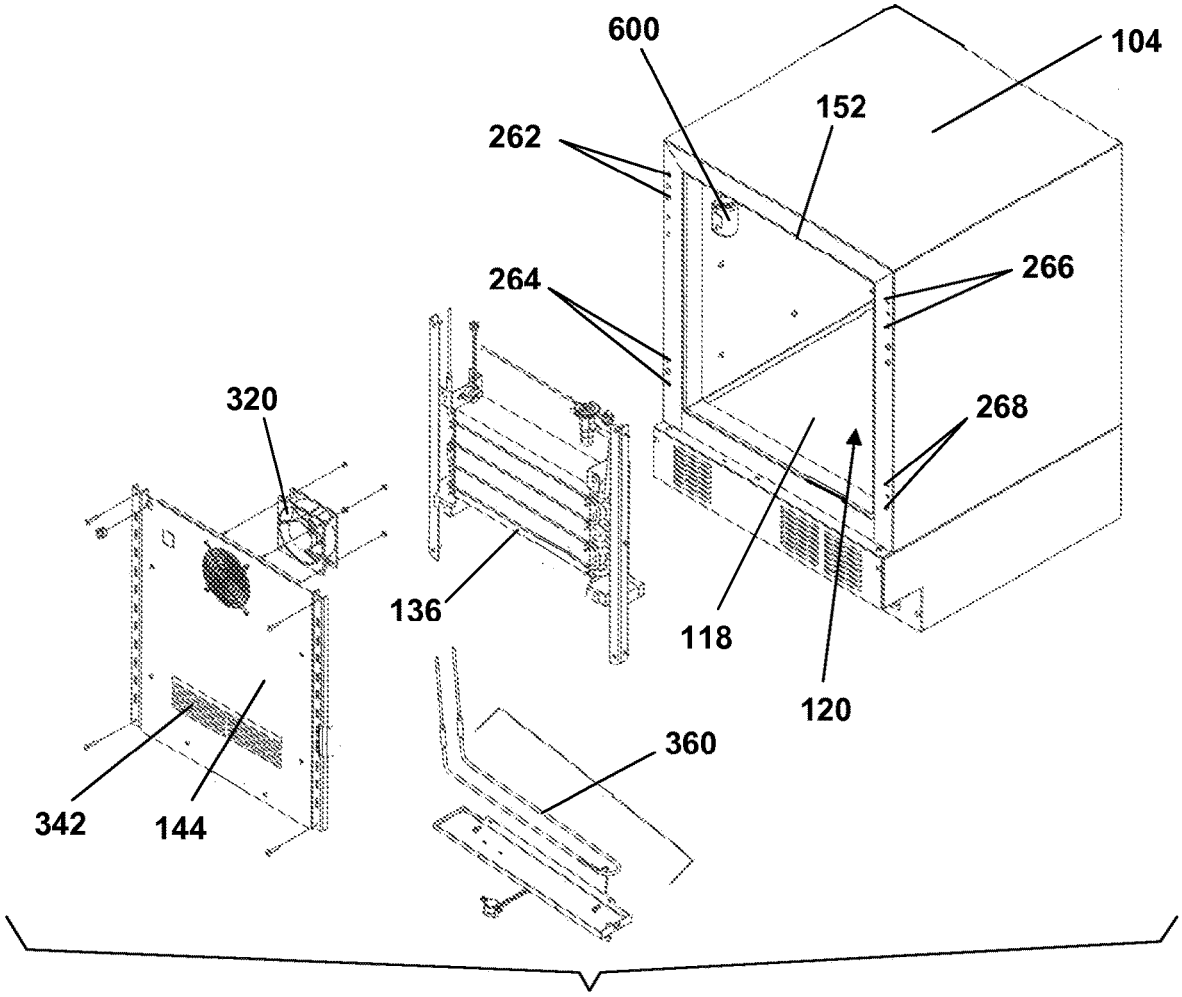
FIG. 20 is an exploded view showing the evaporator unit of a refrigeration system according to the present invention.
Figure 21:
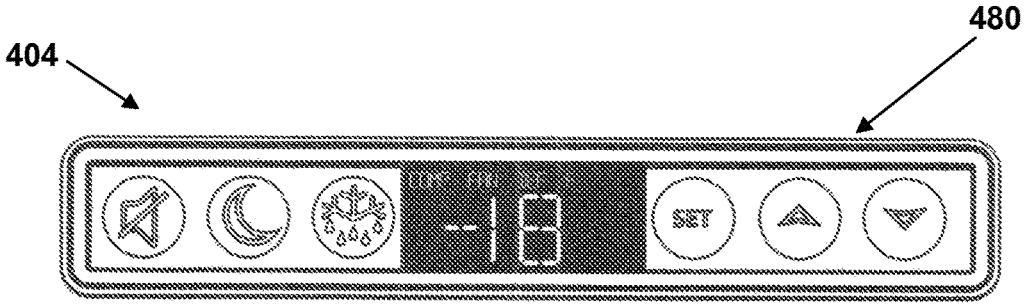
FIG. 21 shows the LED display of a first embodiment of a refrigeration system according to the present invention.
Figure 22:
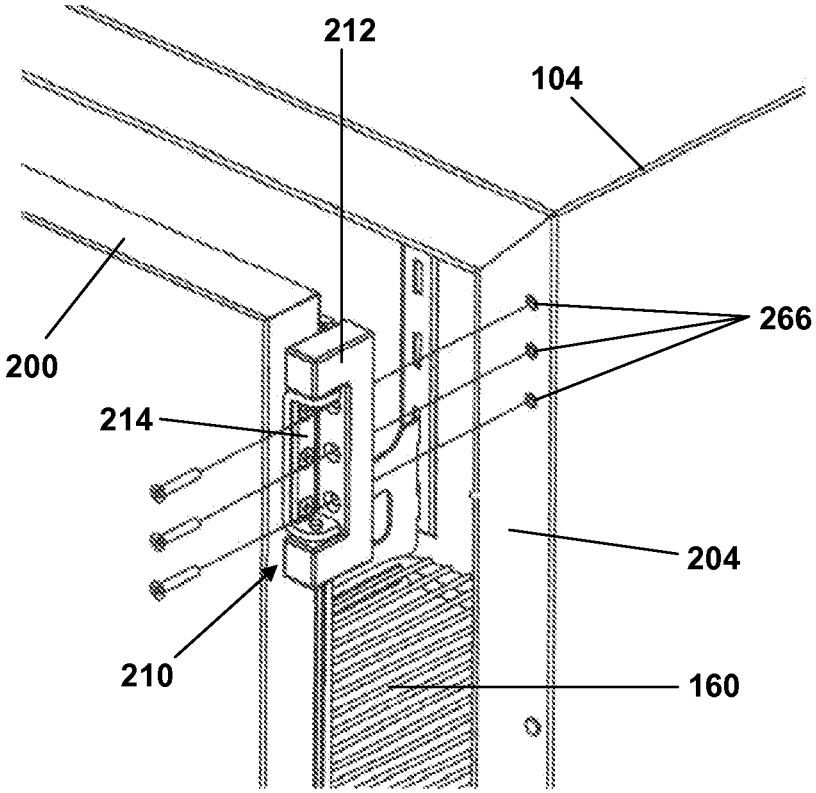
FIG. 22 is a fragmentary view showing details of a hinge of the door of a refrigeration system according to the present invention.
Figure 23:
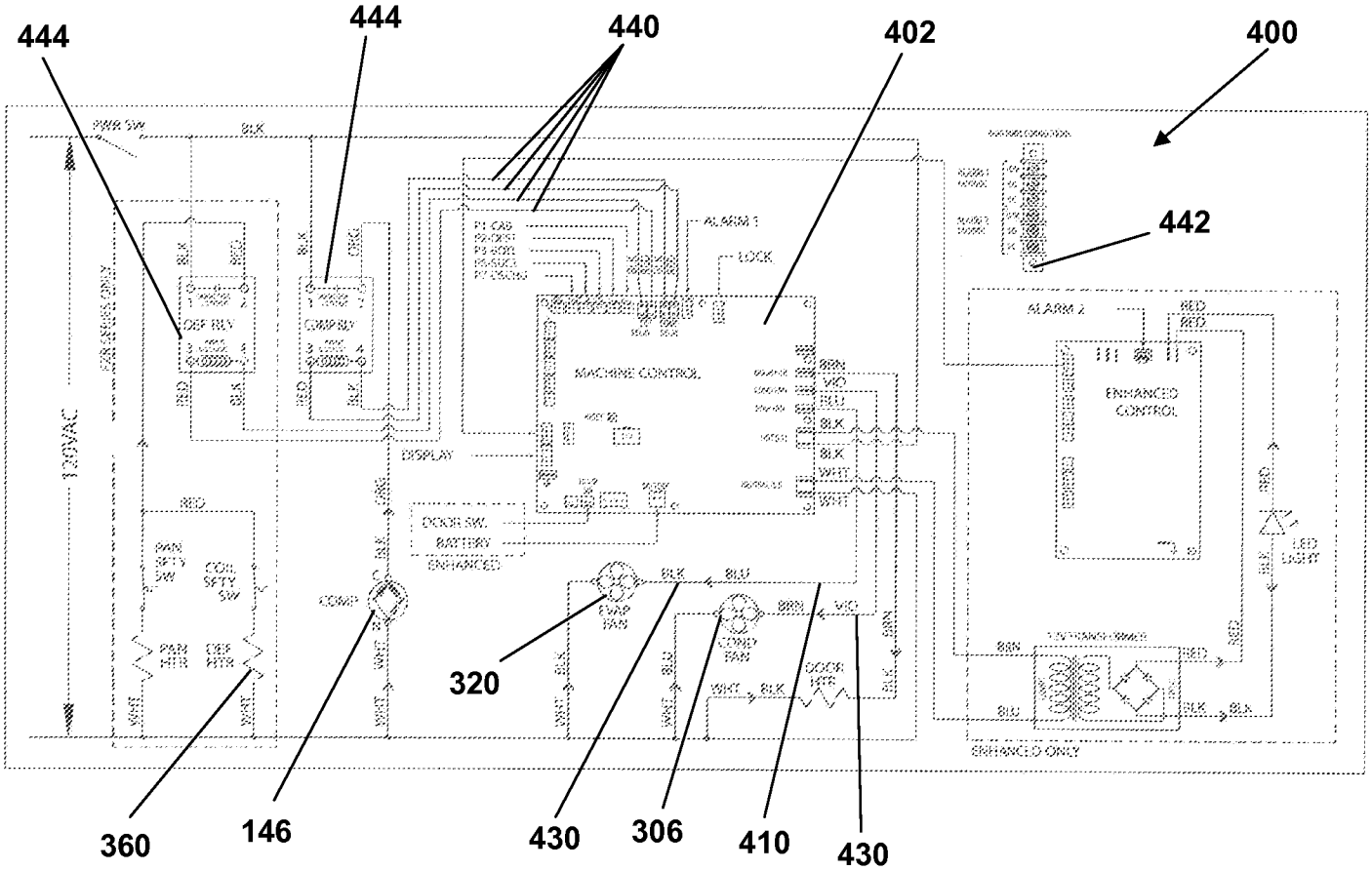
FIG. 23 is a schematic diagram of the control system according to the present invention.
Figure 24:
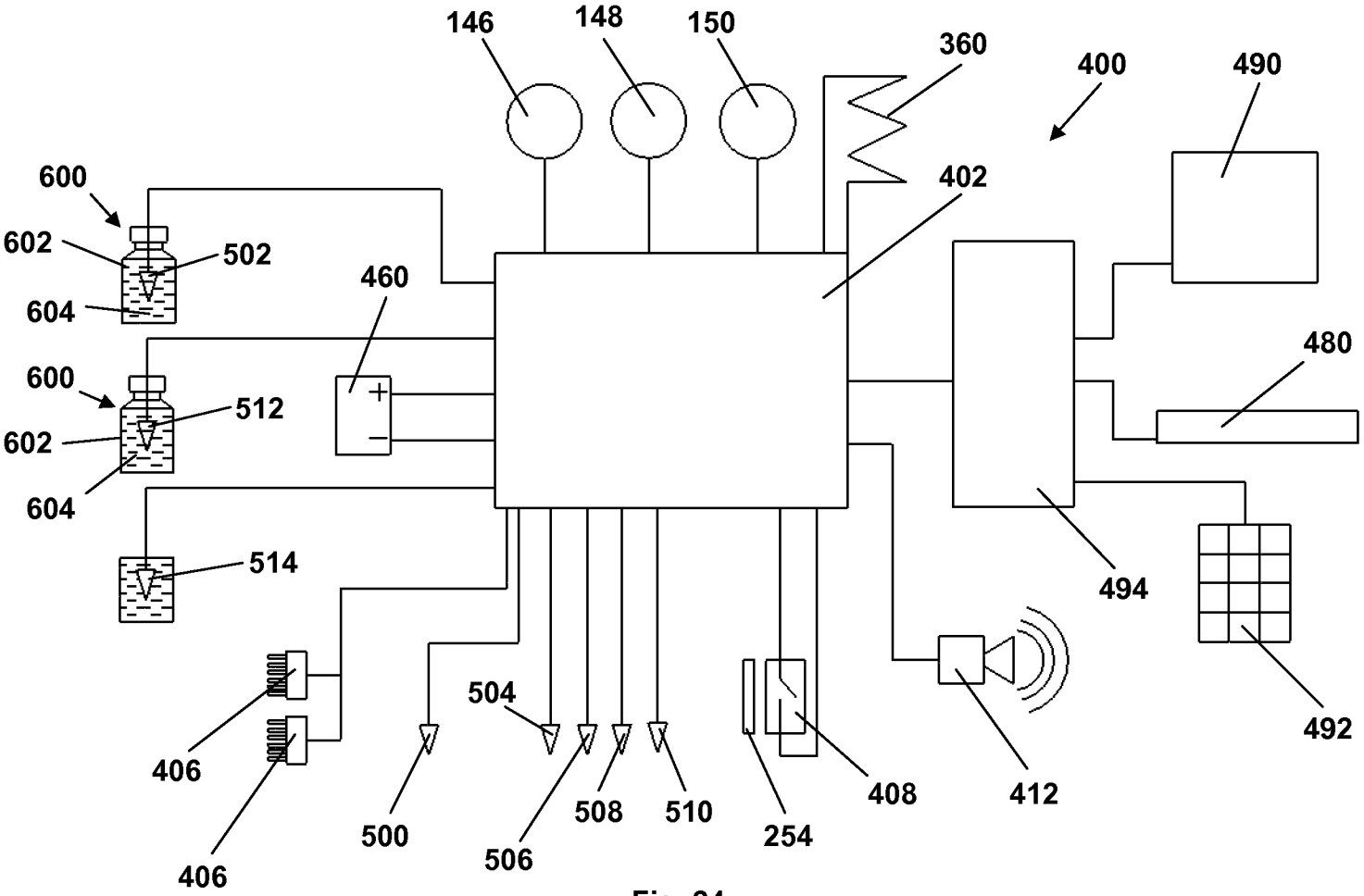
FIG. 24 is a diagrammatic view illustrating the control system according to the present invention.
Figure 25:
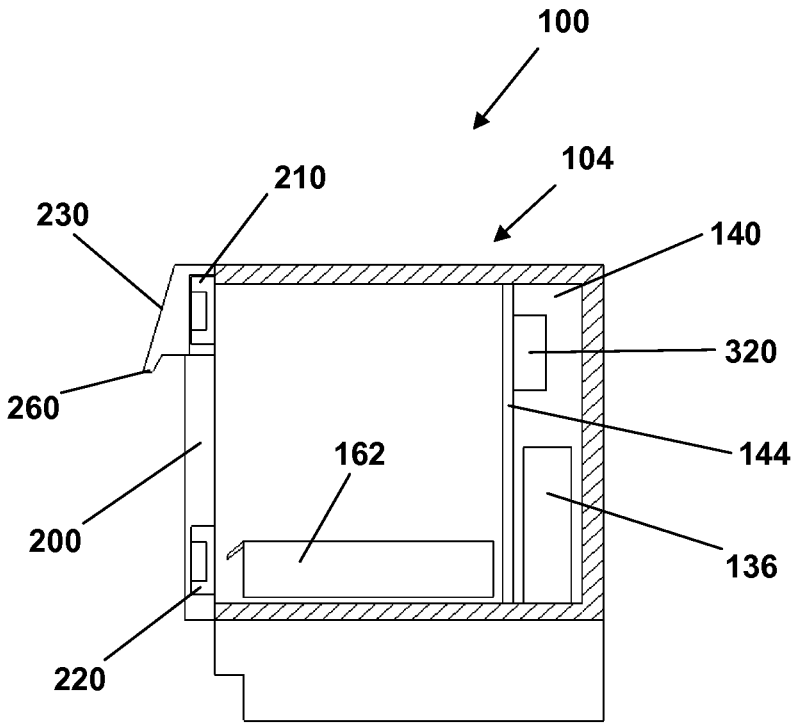
FIG. 25 is a cross sectional view of the enclosure of a refrigeration system according to the present invention.

Referring to FIGS. 1-25, wherein like reference numerals refer to like elements throughout the several views, the refrigeration system 100 of the present invention includes an enclosure 102 that includes a door 104 to provide an enclosed space while allowing user access to the interior of the enclosed space. The refrigeration system of the present invention is a commercial grade system suitable for use in the healthcare industry and capable of meeting the most demanding requirements of that industry. The enclosure 102 of the refrigeration system of the present invention is preferably of stainless steel construction. Preferably, the walls 108 of the enclosure 102 and the door 104 are of double wall construction with both the inner and the outer panel of each of the walls and the door being of stainless steel construction. The space between the inner and the outer panel of each of the walls of the enclosure 102 and the space between the inner and the outer panel of the door 104 are preferably filled with chlorofluorocarbon-free (CFC-free) polyurethane foam insulation to thermally insulate the interior or enclosed space of the enclosure 102 from the external environment of the refrigeration system. The illustrated embodiment 100 of the refrigeration system of the present invention preferably has a storage volume in the range of 3 to 5 cubic feet and is capable of reliably maintaining temperature within 1 degree Centigrade of the set-point. Exemplary embodiments of the refrigeration system of the present invention have storage volumes of 3.9, 4, 4.5, and 5 cubic feet; however, the control system of the present invention, described below, may be applied to any size refrigeration system. The refrigeration system 100 of the present invention utilizes a forced air cooling method to maintain an even airflow distribution and more uniform temperature profile. The refrigeration system 100 can be configured as a refrigerator or freezer. Additionally, the refrigeration system 100 can be configured as an under-the-counter, counter-top, or stackable unit, using a cabinet design common to all configurations.

The refrigeration system 100 includes a condensing unit 300 and an evaporator unit 340. The condensing unit 300 includes a condenser 106, a condenser fan 306, and a compressor 134. The condenser 106, the condenser fan 306, and the compressor 134 are carried on a condensing unit tray 138 positioned under the enclosure 102. The condensing unit tray 138 can slide in or out from under the enclosure 102 for ease of maintenance. The evaporator unit 340 includes the evaporator 136 and the evaporator fan 320. The condensing unit 300 is located outside the insulated interior 120 of the enclosure 102. The evaporator unit 340 is located inside the insulated interior 120 of the enclosure 102 in its own compartment 140 that is separated from the storage compartment 142 of the insulated interior of the enclosure 102 by a partition 144. Temperature control is achieved with a programmable control system 400 utilizing two or more temperature probes or sensors 500, 502, 504, 506, 508, 510, 512, and 514. The refrigeration system 100 is provided with user configurable shelves 160 and drawers 162.

The refrigeration system 100 also includes a thermostatic expansion valve (TXV) 308. The compressor 134, the condenser 106, the condenser fan 306, and the TXV 308 are located outside and below the insulated interior 120 of the enclosure 102 such that the condenser can reject heat to the room air. The evaporator fan 320 is located inside the insulated interior 120 of the enclosure 102 and is in fluid communication with both the evaporator compartment and the storage compartment of the insulated interior 120 of the enclosure 102. In the illustrated example, the evaporator fan 320 is supported at an opening in the panel or partition 144 separating the evaporator compartment and the storage compartment in the insulated interior 120 of the enclosure 102. An air intake 342 for the evaporator 136 is also provided in the panel or partition 144. The evaporator fan 320 circulates the air inside the enclosure 102 through the evaporator 136 to rapidly cool the air inside the enclosure 102 through heat exchange between the air inside the enclosure 102 and the superheated refrigerant inside the evaporator 136. As the liquid refrigerant in the evaporator is vaporized, heat is removed from the air inside the enclosure 102, which supplies the latent heat of vaporization for the refrigerant in the evaporator, thus cooling the air inside the enclosure 102. The refrigerant vapor leaving the evaporator is conducted through a pipe or tube to the suction side or inlet 302 of the compressor 134. The compressor 134 compresses the refrigerant vapor and in the process raises the temperature and pressure of the refrigerant vapor so that the refrigerant vapor leaving the compressor is at a temperature higher than the ambient temperature, i.e. the room temperature or the temperature of the exterior environment, but is in a sub-cooled state. This means that the refrigerant vapor leaving the compressor is at a temperature below the vapor-liquid equilibrium temperature of the refrigerant at the pressure of the outlet of the compressor 134. The compressed vapor is conducted to the condenser 106 where it is condensed back into liquid by rejecting latent heat to the ambient air outside the enclosure 102. The condenser fan 306 forces ambient air through the condenser to increase the rate of heat transfer from the condensing refrigerant to the ambient air to thus increase heat transfer efficiency. The liquid refrigerant leaving the condenser 106 is then recirculated to the evaporator as needed to continue the cooling of the air inside the enclosure 102.

The compressor 134, the evaporator fan 320, and the condenser fan 306 are powered by motors 146, 148, and 150, respectively. The compressor 134 and the compressor motor 146 are hermetically sealed inside the same housing container. The control system 400 causes the motors 146, 148, and 150, and consequently the compressor 134, the evaporator fan 320, and the condenser fan 306, to be energized and working in order to cool the inside of the enclosure 102. The control system 400 includes a microcomputer 402. The control system 400 energizes the compressor 134, the evaporator fan 320, and the condenser fan 306 based upon values for a cut-in temperature and a cut-out temperature that it has been programmed with. In one embodiment, the user enters a set-point and an offset. These two parameters define the cut-in and cut-out temperature of the control system 400 for turning on/off, respectively, the refrigeration system, which means energizing or de-energizing the compressor 134, the evaporator fan 320, and the condenser fan 306, respectively. The control system 400 turns the refrigeration system on when the temperature sensed by the air temperature probe 500 reaches the cut-in temperature, and the control system 400 turns the refrigeration system off when the temperature sensed by the air temperature probe 500 reaches the cut-out temperature. If the user wishes the product to be held at 38° F., for example, they will enter a set-point of 36° F. and an offset of 4° F. resulting in a 40° F./36° F. cut-in/cut-out, with an average temperature of 38° F. temperature being sensed by the temperature sensor 502, which may be placed in a simulated product or on an actual product. This control system, while simple to use, is not readily adaptable to other refrigeration systems without causing confusion to the customer. There are cases where to get the same 38° F. product temperature the cut-in/cut-out temperatures might need to be 39° F./33° F. or even 37° F./34° F. It would be preferable to have a controller that automatically calculates or determines the cut-in/cut-out temperatures based simply on a temperature set-point entered by the user and a strict temperature variation tolerance suitable for the particular application, for example, a blood bank refrigeration system.

In this more preferred embodiment, the user simply enters the product temperature set-point and the microcomputer 402 of the control system 400 determines the cut-in/cut-out temperatures required to keep the product or simulated product temperature within, for example, ±2.2° C. or ±1° C. The microcomputer 402 can be programmed with experimental data tables that it can use to calculate the cut-in/cut-out temperatures, or the microcomputer 402 can be programmed with the code for a heat transfer model of the particular refrigeration system that allows the microcomputer 402 to calculate the cut-in/cut-out temperatures.

The refrigeration system 100 of the present invention provides tight temperature control and monitoring, high and low temperature alarms, data logging, battery backup systems, and the ability to customize these systems to fit customer needs. The refrigeration system 100 of the present invention displays actual product temperature or simulated product temperature, which are more accurate representations of the actual temperature of the items stored in the refrigeration system than the air temperature within the enclosure of the refrigeration system. The air temperature is more prone to relatively wide swings due to, for example, the refrigeration system door 200 being opened, while the actual product temperature remains relatively stable. Displaying the actual product temperature or the simulated product temperature reduces the likelihood of customer confusion as to why the refrigeration system is not holding a steady temperature when in fact it is.

Embodiments of the refrigeration system 100 of the present invention can be made as a refrigerator or as a freezer. The more preferred control system 400 of the present invention allows the user to select the set-point for the temperature in the enclosure of the refrigeration system. The set-point can be set to a temperature in the range of −37 to 10 degrees centigrade. The temperature inside the enclosure of the refrigeration system is preferably maintained within ±2.2° C. (4° F.) of the set-point, and more preferably within ±1° C. (1.8° F.), even with frequent door openings. The temperature inside the enclosure of the refrigeration system is maintained within the aforesaid ranges regardless of the selected set-point temperature. In the refrigerator embodiment, the set-point can preferably be set to a temperature in the range of 2° C. to 10° C. (36° F. to 50° F.). In the freezer embodiment, the set-point can preferably be set to a temperature in the range of −37° C. to −17° C. (−35° F. to 1.8° F.). In the freezer embodiment, the set-point can more preferably be set to a temperature in the range of −37° C. to −18° C. (−35° F. to 0° F.).

The control system 400 incorporates all of the above features, and can be applied to the control of any refrigeration system. The control system of the present invention, and in turn the refrigeration system of the present invention, also incorporates an integral data logger for temperature monitoring and reporting. The data logger may be a portion of the microcomputer memory set aside for that purpose or it can be a mass storage device or medium communicating with the microcomputer.

The refrigeration system 100 includes an enclosure 102 having a door 200, an upper hinge 210 and a lower hinge 220 for the door 200, a control system 400, and a molded plastic or composite façade 230. The enclosure 102 includes a left wall 110, a right wall 112, a back wall 114, a top wall 116, and a bottom wall 118. The enclosure 102 has a front opening 152. The walls of the enclosure 102 define the cabinet 104 of the refrigeration system. The front opening 152 has a left side 122 and a right side 128. The door 200 is adapted to act as a closure for the front opening 152. The door 200 has a left side surface 202 and a right side surface 204. The upper hinge 210 has a first hinge portion 212 and a second hinge portion 214 that are adapted to be pivotally connected to one another. The lower hinge 220 has a first hinge portion 222 and a second hinge portion 224 that are adapted to be pivotally connected to one another. In some embodiments, the refrigeration system 100 may have a window 208 for viewing the interior of the enclosure 102 provided in the door 200.

The control system 400 controls the temperature within the enclosure 102 such that the temperature within the enclosure 102 is maintained within a predetermined or required range relative to a user programmable temperature set-point. The façade 230 houses at least a portion of the control system 400 and is preferably made of a durable and robust plastic or composite material. The façade 230 may be made by molding or any other suitable fabrication process. The façade 230 has a left side 232 and a right side 234. The façade 230 has a molded-in left cut-out 240 on the left side thereof, and the façade 230 has a molded-in right cut-out 242 on the right side thereof. The façade 230 has a molded-in handle 260. The façade 230 is mounted to the door 200 over the top or upper portion of the door 200.

The left side of the front opening 152 has one or more upper mounting points 124 for the first hinge portion of the upper hinge 210, and the left side of the front opening 152 has one or more lower mounting points 126 for the first hinge portion of the lower hinge 220. Similarly, the right side of the front opening 152 has one or more upper mounting points 130 for the first hinge portion of the upper hinge 210, and the right side of the front opening 152 has one or more lower mounting points 132 for the first hinge portion of the lower hinge 220. The left side surface 202 of the door 200 has one or more upper mounting points 262 for the second hinge portion of the upper hinge 210, and the left side surface of the door 200 has one or more lower mounting points 264 for the second hinge portion of the lower hinge 220. Similarly, the right side surface of the door 200 has one or more upper mounting points 266 for the second hinge portion of the upper hinge 210, and the right side surface of the door 200 has one or more lower mounting points 268 for the second hinge portion of the lower hinge 220. This arrangement allows the door 200 to open either on the left side thereof or on the right side thereof on a field-selectable basis. In other words, the end user can select which side the door 200 opens on to best suit their needs. The left cut-out 240 provides clearance for at least part of the upper hinge when the door 200 is hinged on the left side surface thereof, and the right cut-out 242 provides clearance for at least part of the upper hinge when the door 200 is hinged on the right side surface thereof.

The refrigeration system 100 has at least one bracket 270 covered by the façade 230. The bracket 270 connects the façade 230 to the door 200 of the refrigeration system such that a pull force applied to the molded-in handle 260 is transmitted to the door 200 via the bracket 270. The bracket 270 comprises a back-plate 272. The back-plate 272 comprises a rectangular base portion 274 and a pair of extensions 276 each located at either end of the rectangular base portion 274. Each of the pair of extensions 276 has a top flange 278 extending perpendicularly from a top end thereof, and each top flange 278 has attachment means for the attachment of the façade 230 to the bracket 270. The bracket 270 also has a bottom flange 280 extending perpendicularly from the bottom edge of the rectangular base portion 274. The bottom flange 280 has attachment means 282 for attachment of the façade 230 to the bracket 270 at each end thereof. A handle support plate 284 extends below the bottom flange 280 from the edge of the bottom flange 280 that is distal from the rectangular base portion 274. The handle support plate 284 is in contact with the back side of the portion of the molded-in handle 260 that is adapted for engagement by a user's hand or fingers when the user applies a pulling force to open the door 200 such that the bracket 270 will bear and transmit the pulling force to the door 200 without any damaging stress being applied to the façade 230 or the molded-in handle 260. The rectangular base portion 274 and/or the extensions 276 have one or more holes for fasteners that attach the bracket 270 to the outer panel or front 206 of the door 200. The attachment means 282 for attachment of the façade 230 to the bracket 270 may include holes or sleeves for engagement by appropriate fasteners that engage both the façade 230 and the bracket 270 to attach them together. The attachment means 282 for attachment of the façade 230 to the bracket 270 may also provide for indirect attachment using intermediate structures. Also, the fasteners may be integral with the façade 230 and be heated to form heads. The façade 230 may be over-molded to the bracket 270. The fasteners may be rivets, screws, snap fasteners or snap legs, or blind fasteners. The door 200 of the refrigeration system has a width measured from the left side surface of the door to the right side surface of the door, and the molded-in handle 260 extends in a left-to-right direction over a majority of the width of the door 200.

The control system 400 includes a microcomputer 402, at least first and second temperature sensors 500 and 502, user interface means 404, an external device interface 406, a door opening sensor 408, interface means 410 for allowing the microcomputer 402 to control the means for forced air circulation such as the evaporator fan 320, and at least one alarm means 412. The first temperature sensor 500 communicates with the microcomputer 402 and is located in an air intake stream to the evaporator 136 or directly on the evaporator 136. The second temperature sensor 502 communicates with the microcomputer 402 and is in contact with a simulated product or an actual product placed within the enclosure 102. Preferably, the second temperature sensor 502 is in contact with a simulated product 600 placed within the enclosure 102. The user interface means 404 allows a user to program the control system 400 with one or more temperature or other control parameters. The user interface means 404 may be a combination of an LED display 480 and a plurality of function keys for user inputs, and it may also include a keypad 492 to give the user more options and greater flexibility in programming the control system 400. Alternatively, the user interface means 404 may be a capacitive touch-screen 490 that provides both input and output functions. Electronic interface means 406, for example a universal serial bus (USB) port or a network jack, allows the microcomputer 402 to communicate with an external electronic device, such as a USB memory device or a remote computer, for data entry, programming, data retrieval, monitoring, issuing alarms and alerts, etc. The door opening sensor 408 communicates with the microcomputer 402 and signals the microcomputer 402 when the door 200 is open. The interface means 410 allows the microcomputer to control the means for forced air circulation 320 can be a relay 444 switched on and off by a control signal from the microcomputer 402. If the fan power requirement is low enough the interface means 410 may just be a wire from the microcomputer motherboard with the power switched on and off by on-board solid state control circuitry, which may also include a solid state relay. The relay 444 may be a solid state relay.

The alarm means 412 generates an alarm to alert a user when a temperature sensed by the second temperature sensor 502 rises above a predetermined value. The alarm means can be an audible alarm such as a buzzer or siren, it may be visual such as flashing lights or flashing messages on system display or a remote computer screen, or any combination of all of these. The control system 400 operates to maintain the temperature sensed by the first temperature sensor 500 within a desired range using the temperature control parameters supplied by the user. This in turn maintains the temperature sensed by the second temperature sensor 502 within the desired rage. The control system 400 uses the temperature sensed by the first temperature sensor 500 to cut-in and cut-out the operation of the refrigeration system to cool the air inside the enclosure 102.

The microcomputer 402 stops operation of the means for forced air circulation 320 when door opening is detected and starts operation of the means for forced air circulation 320 when door closing is detected to return the temperature sensed by the first temperature sensor 500 to within the desired range when the temperature sensed by the first temperature sensor is outside the desired range. Preferably, the door opening sensor 408 is of the magnetic type. Alternatively, the door opening sensor 408 can be a mechanical type such as a pressure switch or the like that closes when the door 200 is opened.

The microcomputer 402 is also programmed to at least log temperature readings from the first and second temperature sensors 500, 502 at predetermined intervals of time. The control system 400 is capable of storing up to 50,000 readings per temperature sensor. The default setting for the sample rate is every 15 minutes, which will provide enough storage for 520 days. The sample rate can be changed by the user to provide data logging for a longer or shorter time interval by changing the Sample Rate.

Preferably, the temperature control parameters include a user selected temperature set-point, and exclude cut-in and cut-out temperatures and off-sets, and the control system 400 determines the cut-in and cut-out temperatures needed to maintain the temperature sensed by the temperature sensor 502, located inside the enclosure 102, within a desired range. The control system 400 then operates to maintain the temperature sensed by the temperature sensor 502 within the desired range by turning the refrigeration system on and off based on the cut-in and cut-out temperatures determined by the control system 400. This system eliminates the need for guess work on the part of the user.

The control system 400 also may include at least one defrost heater 360 that communicates with the microcomputer 402 such that it can be turned on or off by the microcomputer 402. A third temperature sensor 504 communicates with the microcomputer 402 and is positioned to monitor the temperature of the evaporator 136. The microcomputer 402 operates to turn the defrost heater 360 on or off based upon the temperature sensed by the third temperature sensor 504. Alternatively, the defrost heater 360 may be turned off after a preprogrammed or user selected time period. As yet another alternative, the defrost heater 360 may be turned on at preprogrammed or user selected time intervals and turned off after a preprogrammed or user selected time period.

The control system 400 may include fourth temperature sensor 506 provided upstream of the inlet to the compressor 134. Preferably, the fourth temperature sensor 506 is located at or in proximity to the compressor inlet. The fourth temperature sensor 506 communicates with the microcomputer 402. The microcomputer 402 generates a system alert or alarm when the temperature sensed by the fourth temperature sensor 506 falls below a predetermined temperature corresponding to an unacceptably high probability that liquid may be slugging into the compressor 134, which may cause compressor damage. For example, the predetermined temperature corresponding to an unacceptably high probability that liquid may be slugging into the compressor may typically be about 5° F. and can be set to a temperature in the range of −100 to 100° F.

The user interface means 404, which may include a display 480 or 490, is supported by the façade 230. The display or user interface controller 494 may also be housed in the façade 230. The display 480, 490 can be operated to display at least a user selectable one of the temperature measured using the first temperature sensor 500 and the temperature measured using the second temperature sensor 502. The display 480, 490 displays the temperature measured using the second temperature sensor 502 by default.

Preferably, the control system 400 includes a simulated product 600 located within the enclosure 102. Preferably, the simulated product 600 has a heat capacity and heat transfer coefficient approximating those of actual products that are to be kept in the enclosure. In one preferred embodiment, the second temperature sensor 502 senses the temperature of the simulated product 600. In the illustrated example, the simulated product 600 comprises a bottle 602 and a liquid 604 at least in part filling the bottle 602. The second temperature sensor 502 is positioned in the liquid 604. Preferably, the liquid in the bottle 602 is glycerin.

The control system 400 may further include a fifth temperature sensor 508 provided downstream of the compressor 134 to monitor the compressor discharge temperature. Preferably, the fifth temperature sensor 508 is located at or in proximity to the compressor outlet. The fifth temperature sensor 508 communicates with the microcomputer 402. The microcomputer 402 monitors the compressor discharge temperature and operates to shut down the refrigeration system when the compressor discharge temperature exceeds a predetermined value. This predetermined value is typically about 230 to 250° F. and is user settable within a range of 100 to 250° F.

The control system 400 may further include a sixth temperature sensor 510 provided to monitor the temperature of the condenser air inlet. The sixth temperature sensor communicates with the microcomputer 402. The microcomputer 402 generates a system alert that maintenance may be required when the temperatures sensed by the fourth, fifth, and sixth temperature sensors together are indicative of an abnormal condition in the refrigeration system.

The control system 400 may further include multiple additional product and/or simulated product temperature sensors, such as the seventh and eighth temperature sensors 512 and 514, provided at separate locations within the enclosure 102 for a more comprehensive and accurate monitoring of the temperatures within the enclosure 102. These additional probes would all be communicating with the microcomputer 402. The microcomputer 402 would log temperature readings from all such additional temperature sensors at predetermined intervals of time mentioned previously. The microcomputer 402 would generate an alarm to alert a user when a temperature sensed by any of the product or simulated product temperature sensors rises above or falls below a predetermined or user selected value using, for example, the alarm means 412. The alarm would be generated, for example, when the product or simulated product temperature falls outside the ±2.2° C. or ±1° C. tolerance of the user selected temperature set-point.

The control system 400 monitors and by default displays the temperature of the product or simulated product temperature probe 502, thus providing a more accurate representation of the state of the product temperatures within the enclosure 102. This avoids unnecessary alarm and confusion on the part of the user or operator of the refrigeration system. The control system 400 provides the user with the ability to view the high and low temperatures, and when they occurred with a timestamp display. The user has the ability to reset the high/low temperatures.

The refrigeration control system includes a data logging feature. The control can be set to log at the programmable rates previously described. The data is stored in multiple locations to facilitate quick display and downloading to USB devices. The control is always logging every probe input, thus allowing quick display and data retrieval, regardless of the probe or probes selected for display.

The control system 400 logs all system event functions, alerts, and parameter changes. The system will also log all probe or sensor inputs, and present the data for download separate from the complete events log. This allows the user to easily access the temperature data, or download the system log for troubleshooting support. The system maintains the log in a circular system, replacing older data with new data on an ongoing basis. The refrigeration control system 400 includes a programmable data duration alarm, which alerts the user to download and erase the data after a set duration.

The refrigeration control system 400 includes multiple controlled high voltage outputs 430 to provide separate control of condenser fan, evaporator fan, defrost heaters, mullion heaters (not shown), etc. In addition, multiple low voltage outputs 440 are provided for separate control of higher current devices such as compressors and defrost heaters. By providing a low-voltage output an "off board" solid state relay 444 can be applied to carry the higher current. This allows the controller to control a wide range of refrigeration systems utilizing compressors of different sizes.

The refrigeration control system 400 includes inputs and outputs for controlling Pulse-Width-Modulation devices, such as compressor or fans. This feature allows for dynamic speed control of motor driven items which will allow for a more efficient control of the refrigeration system during peak and idle demand periods.

The refrigeration control system 400 includes multiple temperature alarm routines that can be individually programmed and set. Each alarm routine can be set to monitor a separate probe or sensor input. The refrigeration control system 400 includes multiple dry contacts 442 that can close when an alarm or alert event occurs.

The refrigeration control system 400 includes a USB port for downloading of log files, and parameter files. The parameter files can also be imported for quick programming. The USB port can also be used to update the firmware of any and all devices connected to the control system.

The refrigeration control system 400 includes an input for a door switch connection. The control system turns the refrigeration system 100 off in whole or in part when the door is opened, and sounds an alarm if the door remains open for more than a programmable or predetermined period of time.

The refrigeration control system 400 has a provision to operate from a backup battery 460 in the event of a power loss. This enables the control system 400 to continue logging the product temperature so the user knows if and when the product temperature has gone out of range. The battery provision will also sound an alert and has the ability to activate the alarm contacts to alert a third party.

The enclosure of the refrigeration system provides a common cabinet design for both refrigerators and freezers. The enclosure of the refrigeration system provides for a flexible arrangement of shelves and drawers. The molded handle is robust, and the façade provides an ergonomically appropriate placement for the integrated display. The door is field convertible from right opening to left opening and has an integral cable for the display controller.

The refrigeration system incorporates a common cabinet that is used for both refrigerator and freezer models, with shelves, drawers or a combination of both. The cabinet design relocates the shelf supports to the back wall, thus freeing the side walls for mounting of the drawers. The illustrated embodiment allows for any mix of up to two fixed position drawers and flexibly located shelves.

The façade 230 is treated to have antimicrobial properties. The molded plastic façade also serves as the mounting support for the control system display. The display is mounted in such a fashion as to be ergonomically available to user—presented at the top of the door and angled slightly back to improve readability and usage. For example, the display may be angled back at between about two to ten degrees from the vertical, more preferably from about three and eight degrees from the vertical, and still more preferably about six degrees from the vertical. The molded façade will accept either a standard LED based display or a larger, more complex LCD touchscreen.

The door 200 incorporates a bottom cap 250 which is designed to house the display cable 252. The bottom cap 250 is configured to allow the cable 252 to be brought to the left or right side, depending upon the side on which the door 200 is hinged. The bottom cap 250 also supports a magnet 254 to act as the trigger to the door opening switch or detector 408. The display cable 252 emerges from an opening in the bottom cap 250 at about the center of the bottom cap. Running along the length of the bottom cap 250 there are channels 256 and 258 on either side of the opening for the display cable 252. The display cable 252 is routed through the left channel 256 when the door 200 is hinged on the left, and the display cable 252 is routed through the right channel 258 when the door 200 is hinged on the right. The channels 256, 258 are formed along the bottom of the bottom cap 250 such that they and the display cable 252 are hidden from view by the bottom cap, once the refrigeration system is installed and running, for an aesthetically pleasing appearance. A screw fastened strap 310 is used to secure the display cable 252 in either the left or the right channel with the screw fastened strap 310 being fastened to the bottom cap near either the left or the right side, respectively, of the door 200.

The temperature probes or sensors 500, 502, 504, 506, 508, 510, 512, and 514 may be of any suitable type including but not limited to thermocouples and thermistors.

An important advantage of the control system 100 is that it allows the end user or their authorized employees to customize the control system and in turn the refrigeration system to suit their particular needs by having the flexibility to select the operating parameters of the control system 100. The word "user" means any person with authorized access to change the settings of or program the control system 400, including updating the firmware of the control system. "Users" include factory technicians, service technicians, persons charged with the responsibility for monitoring the system remotely, and end users.

In control systems that incorporate the keypad 492 or the touch-screen 490, users can be assigned individual access codes. One or more access codes can be assigned "master user" status, and the ability to change system settings or to reprogram the control system may be limited only to master users. The control system 400 may optionally include an electronic lock for the door 200 that could limit access to the contents of the refrigeration system only to those persons having a valid user code. The system could then also log the identity of the individual user accessing the contents of the refrigeration system in addition to logging the date and time of such events.

Appended herein below as Appendix A and Appendix B are Installation, Operation and Service Manuals by Follett Corporation, the applicant in the instant application, for refrigerators and freezers, respectively. The appended manuals in Appendix A and Appendix B are incorporated by reference herein in their entirety and form part of the original disclosure of the present application.

This invention is not limited to the illustrative embodiments described above and encompasses any and all embodiments within the scope of the appended claims and their equivalents.

The invention claimed is:

1. A control system for controlling temperature within an enclosure of a refrigeration system having an evaporator and means for forced air circulation past the evaporator, the enclosure having an interior, the control system comprising:

a microcomputer, the means for forced air circulation being energized and deenergized under control of said microcomputer;

a first temperature sensor communicating with said microcomputer, said first temperature sensor being located in a place selected from an air intake stream to the evaporator and directly on the evaporator itself;

a second temperature sensor communicating with said microcomputer, said second temperature sensor being in contact with one of a first simulated product and a first actual product placed within the enclosure;

user interface means to allow a user to program the control system with one or more temperature control parameters;

a door opening sensor communicating with said microcomputer; and alarm means for generating an alarm to alert a user when a temperature sensed by said second temperature sensor is outside a desired temperature range that is based upon the one or more temperature control parameters, wherein said microcomputer determines upper and lower temperature limits based upon the one or more temperature control parameters, the control system operates the refrigeration system to cool the interior of the enclosure of the refrigeration system when a temperature sensed using said first temperature sensor is at or above the upper temperature limit, the control system stops operation of the refrigeration system to cool the interior of the enclosure of the refrigeration system when the temperature sensed using said first temperature sensor reaches the lower temperature limit, wherein the microcomputer at least stops operation of said means for forced air circulation when door opening is detected while the control system is operating the refrigeration system to cool the interior of the enclosure of the refrigeration system, wherein the control system operates the refrigeration system to cool the interior of the enclosure of the refrigeration system when, after door closing is detected, the temperature sensed using said first temperature sensor is at or above the upper temperature limit, wherein the second temperature sensor measures either a simulated product temperature from the first simulated product or an actual product temperature from the first actual product, respectively, wherein the simulated product temperature is a representation of the actual product temperature, and wherein said microcomputer logs temperature readings from said first and second temperature sensors at predetermined or user selected intervals of time, the microcomputer maintaining the log in a circular system, the microcomputer replacing older data with new data after a set duration.

2. The control system according to claim 1, wherein the temperature control parameters include a temperature setpoint selected by the user.

3. The control system according to claim 1, further comprising a display adapted for being supported by a façade of the refrigeration system and communicating with said microcomputer, wherein said display by default displays the temperature measured using said second temperature sensor.

4. The control system according to claim 1, wherein the evaporator has a temperature, the control system further comprising:

a defrost heater communicating with said microcomputer, wherein said microcomputer operates to turn said defrost heater on at predetermined or user selected intervals of time for a predetermined or user selected duration.

5. The control system according to claim 1, further comprising the first simulated product located within the enclosure.

6. The control system according to claim 5, wherein said simulated product comprises a bottle and a liquid at least in part filling said bottle, wherein said second temperature sensor is positioned in said liquid.

7. The control system according to claim 6, wherein said liquid is glycerin.

8. The control system according to claim 1, wherein the evaporator has a temperature, the control system further comprising:

a defrost heater communicating with said microcomputer;

a third temperature sensor communicating with said microcomputer, said third temperature sensor being positioned to monitor the temperature of the evaporator, wherein said microcomputer operates to turn said defrost heater on based upon a temperature sensed by said third temperature sensor.

9. The control system according to claim 8, wherein said microcomputer operates to turn said defrost heater off based upon one of a temperature sensed by said third temperature sensor and a predetermined or user selected duration.

10. The control system according to claim 8, wherein the refrigeration system further comprises a compressor having an inlet and an outlet, the control system further comprising:

a fourth temperature sensor provided at or in proximity of the inlet to the compressor, said fourth temperature sensor communicating with said microcomputer, said microcomputer generating a system alert when a temperature sensed by said fourth temperature sensor falls to or below a predetermined temperature, wherein operation of the compressor at inlet temperatures below the predetermined temperature may cause compressor damage.

11. The control system according to claim 10, further comprising:

a fifth temperature sensor provided at or in proximity to the outlet of the compressor to monitor a compressor discharge temperature, said fifth temperature sensor communicating with said microcomputer, said microcomputer monitoring the compressor discharge temperature, said microcomputer operating to shut down the refrigeration system when the compressor discharge temperature exceeds a predetermined or user selected value for the compressor discharge temperature.

12. The control system according to claim 11, wherein the refrigeration system further comprises a condenser and a condenser air inlet, the control system further comprising:

a sixth temperature sensor provided to monitor temperature in the condenser air inlet, said sixth temperature sensor communicating with said microcomputer, said microcomputer generating a system alert that maintenance may be required when the temperatures sensed by said fourth, fifth, and sixth temperature sensors together are indicative of an abnormal condition in the refrigeration system.

13. The control system according to claim 12, further comprising a seventh temperature sensor communicating with said microcomputer, said seventh temperature sensor being in contact with one of a second simulated product and a second actual product placed within the enclosure, wherein said microcomputer logs temperature readings from said seventh temperature sensor at the predetermined intervals of time.

14. The control system according to claim 13, further comprising an eighth temperature sensor communicating with said microcomputer, said eighth temperature sensor being in contact with one of a third simulated product and a third actual product placed within the enclosure, wherein said microcomputer logs temperature readings from said eighth temperature sensor at the predetermined intervals of time.

* * * * *